US006683289B2

(12) United States Patent
Whitmore et al.

(10) Patent No.: US 6,683,289 B2
(45) Date of Patent: Jan. 27, 2004

(54) HAND-HELD FOOD PACKAGE

(75) Inventors: Shana Whitmore, Manhattan Beach, CA (US); Stuart Decelles, Upland, CA (US); Jeannette Dido, Hoboken, NJ (US); Neil A. Willcocks, Flanders, NJ (US); Gary Chisholm, Rancho Palos Verdes, CA (US)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 10/190,210

(22) Filed: Jul. 3, 2002

(65) Prior Publication Data

US 2003/0080120 A1 May 1, 2003

Related U.S. Application Data

(63) Continuation-in-part of application No. 10/037,424, filed on Oct. 29, 2001.

(51) Int. Cl.[7] ..... H05B 6/80

(52) U.S. Cl. ..... 219/730; 219/729; 219/735; 426/112

(58) Field of Search ..... 219/725, 727, 219/728, 729, 730, 732, 735, 686; 99/DIG. 14; 426/107, 109, 112, 113, 118, 234, 241, 243, 90, 232; 229/903, 198.2, 403; 383/100, 103, 204; 428/34.6

(56) References Cited

U.S. PATENT DOCUMENTS

| | | | |
|---|---|---|---|
| 2,617,549 | A | 11/1952 | Egger |
| 3,785,254 | A | 1/1974 | Mann |
| 3,908,523 | A | 9/1975 | Shikaya |
| 3,961,569 | A | 6/1976 | Kenyon et al. |
| 4,080,880 | A | 3/1978 | Shikaya |
| 4,155,895 | A | 5/1979 | Rohowetz et al. |
| 4,435,344 | A | 3/1984 | Iioka |

(List continued on next page.)

FOREIGN PATENT DOCUMENTS

| | | | |
|---|---|---|---|
| EP | 1190960 | A2 | 3/2002 |
| GB | 2352706 | A | 2/2001 |
| JP | 2001353069 | | 12/2001 |

*Primary Examiner*—Quang T. Van
(74) *Attorney, Agent, or Firm*—Fulbright & Jaworski L.L.P.

(57) ABSTRACT

The present invention is directed to a hand-held microwaveable container formed from microwaveable appropriate material, The container includes a thermal insulating layer that allows a microwaved container to be removed from a microwave oven and held in a user's hand while using the contents of the container. The container also can include a susceptor surface adjacent the food item within the container. The container further includes an opening mechanism for easily opening the container and optionally a venting mechanism.

35 Claims, 25 Drawing Sheets

U.S. PATENT DOCUMENTS 4,641,005 A 2/1987 Seiferth
4,775,771 A 10/1988 Pawlowski et al.
4,780,587 A 10/1988 Brown
4,825,025 A 4/1989 Seiferth
4,848,649 A 7/1989 Fuller et al.
4,948,932 A 8/1990 Clough
5,009,326 A 4/1991 Reaves et al.
5,038,009 A 8/1991 Babbitt
5,092,485 A 3/1992 Lee
5,114,068 A 5/1992 Reil et al.
5,205,473 A 4/1993 Coffin, Sr.
5,215,249 A 6/1993 Gorrieri
5,231,268 A * 7/1993 Hall et al. ..... 219/730
5,241,150 A 8/1993 Garvey et al.
5,254,821 A 10/1993 Walters
5,300,746 A 4/1994 Walters et al.
5,411,202 A 5/1995 Fenini
5,464,969 A 11/1995 Miller
5,530,231 A 6/1996 Walters et al.
5,698,127 A 12/1997 Lai et al.
5,772,111 A 6/1998 Kirsch
5,826,786 A 10/1998 Dickert
5,830,548 A * 11/1998 Andersen et al. ..... 428/36.4
5,839,653 A 11/1998 Zadravetz
5,858,487 A * 1/1999 Boehler et al. ..... 428/34.3
6,054,698 A 4/2000 Mast
6,102,281 A 8/2000 Lafferty et al.
6,114,679 A 9/2000 Lai et al.
6,133,560 A 10/2000 Zeng et al.
6,150,646 A 11/2000 Lai et al.
6,196,408 B1 3/2001 Setty et al.
6,251,451 B1 6/2001 Zeng
6,259,079 B1 7/2001 Ji et al.
6,261,611 B1 7/2001 Berman
6,386,438 B1 5/2002 Walsh et al.
2002/0037344 A1 * 3/2002 Montserrate Gibernau . 426/112

* cited by examiner

HAND-HELD FOOD PACKAGE

This is a continuation-in-part of U.S. application Ser. No. 10/037,424, which was filed on Oct. 29, 2001.

FIELD OF THE INVENTION

The present invention relates to a hand-held package for use as a convenient microwaveable food container. More particularly, the package includes a thermal insulating surface to protect the consumer from the hot food item.

BACKGROUND OF THE INVENTION

The use of microwave energy for cooking has been available for many years. Microwave shielding material is known in the art to shield microwave energy from a food product or to focus microwave energy to a particular portion of a food product in order to cook the food. Microwave susceptor materials are known in the art and are used in microwave cooking apparatuses for directly heating food and for browning by conduction from the microwave susceptor material heated by the absorption of microwaves.

Numerous microwavable products are on the market that consists of food items such as burritos, croissant pockets, sandwiches and pizzas, packaged in various kinds of cartons, trays and pouches. The food items of these products are typically removed from an outer carton or wrapper and placed in a microwave oven for cooking. A susceptor material may or may not surround the food item while cooking. At the completion of cooking, the food items are removed from the microwave oven and have a required sit time, before the product can be handled for eating.

The self-venting microwaveable package disclosed in U.S. Pat. No. 5,464,969 is a microwaveable plastic bag for heating a variety of products including liquids. One seam of the bag incorporates a strip seal that vents when enough pressure is generated in the bag in order to prevent explosion of the bag.

A multi-layer microwave conductive structure is disclosed in U.S. Pat. No. 5,530,231, which is incorporated herein by reference. The disclosed conductive structure for use in microwave food packaging adapts itself to heat food articles in a safer, more uniform manner. The structure includes a conductive layer disposed on a non-conductive substrate. An aspect of the structure's conductive layer of links and base areas causes microwave induced current to be channeled through the links resulting in controlled heating.

Metallized microwave diffuser films are disclosed in U.S. Pat. No. 5,300,746, which is incorporated herein by reference. The films include an insulative substrate, having a first side upon which is deposited a metallic coating capable of selectively reflecting a portion of incoming microwave energy.

Sleeves for browning or crisping food in microwave ovens are known in the art as described in U.S. Pat. Nos. 4,948,932 and 4,775,771. These patents describe sleeves formed from flexible or semi-flexible substrates that include a susceptor material. A food item is placed within the sleeve and then cooked in microwave oven. Sleeves for insulating containers containing hot liquids are described in U.S. Pat. No. 5,205,473 which discloses an insulating beverage container holder formed of a tubular sleeve made from corrugated cellulose material. However, the sleeves of the U.S. Pat. No. 5,205,473 patent are not designed for insulating a container containing a food item that is being cooking in a microwave oven.

Those systems, which disclose containers for heating or cooking using microwave energy or disclose materials which reflect microwave energy or become hot upon contact with microwave energy transmission, may be used to heat and cook food products adequately, however, the containers that contain the food become extremely hot. In this respect, the present microwaveable packages are time consuming and inefficient because time is lost in waiting for the container to cool before it can be handled and/or the food has to be transferred to another receptacle that can be held. The microwavable packages are not designed for handling while eating the cooked food at its optimal temperature because at the optimal eating temperature the package is too hot to hold. Further, current microwavable packages are not configured to fit in one hand of the user while being eaten.

Therefore, there is a need in the art for a microwave cooking package system which may be used to cook/heat a fresh, frozen or refrigerated, cooked or uncooked food item in a microwave oven that is a hand held microwave appropriate container designed for single handed eating and portability. There is also a need in the art for a hand held container that is configured to provide the user with a cool surface for holding the container and eating the contents of the container, while keeping the contents of the container hot. Thus, the present invention allows for immediate handling of the container and eliminates the need for additional receptacles to hold the hot food item.

BRIEF SUMMARY OF THE INVENTION

The present invention is directed to a hand-held package for use as a convenient microwaveable food container. Specifically, the package is formed from a microwaveable appropriate material and is insulated to protect the consumer from the hot food item.

One embodiment of the present invention is a hand held microwaveable container having a thermal insulating layer in which the insulating layer allows a microwaved container to be removed from a microwave oven and held in a user's hand while eating a food item from the container. The container also may include a susceptor surface adjacent the food item within the container and an opening mechanism for easily opening the container. The susceptor includes a substrate having a microwave-absorptive coating region, which can be deposited, printed, extruded, or laminated on the substrate.

Another embodiment of the present invention is a hand held microwaveable container which includes an outer component formed from a semi-rigid material and an inner component formed from a flexible material and one or both of the components includes an easy opening mechanism. A thermal insulating surface is on at least a portion of the outer component. The inner component can include a microwave susceptor surface and the outer component can be in the shape of a sleeve, a cup or a carton.

A further embodiment of the present invention is a hand held microwaveable container which includes an outer component formed from a flexible material and an inner component formed from a semi-rigid material and one or both of the components can include an easy opening mechanism. A thermal insulating surface is on at least a portion of the outer component and the inner component can include a microwave susceptor surface. The outer component can be in the shape of a sleeve, a cup or a carton.

Another embodiment of the present invention is a hand held microwaveable container which includes an outer component and an inner component formed from a flexible material in which one or both of the components can include an easy opening mechanism. A thermal insulating surface is on at least a portion of the outer component. The inner component can including a microwave susceptor surface and can be in the shape of a sleeve, a cup or a carton.

A still further embodiment of the present invention is a hand held microwaveable container formed from a rigid, semi-rigid or flexible microwavable appropriate material in which a thermal insulating surface is on at least a portion of the container. The container can also include a microwave susceptor surface and an easy opening mechanism.

The foregoing has outlined rather broadly the features and technical advantages of the present invention in order that the following detailed description of the invention may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only, and is not intended as a definition of the limits of the present invention.

BRIEF DESCRIPTION OF THE DRAWINGS

For a more complete understanding of the present invention, reference is now made to the following descriptions taken in conjunction with the accompanying drawings.

DETAILED DESCRIPTION OF THE INVENTION

Figure 1A:
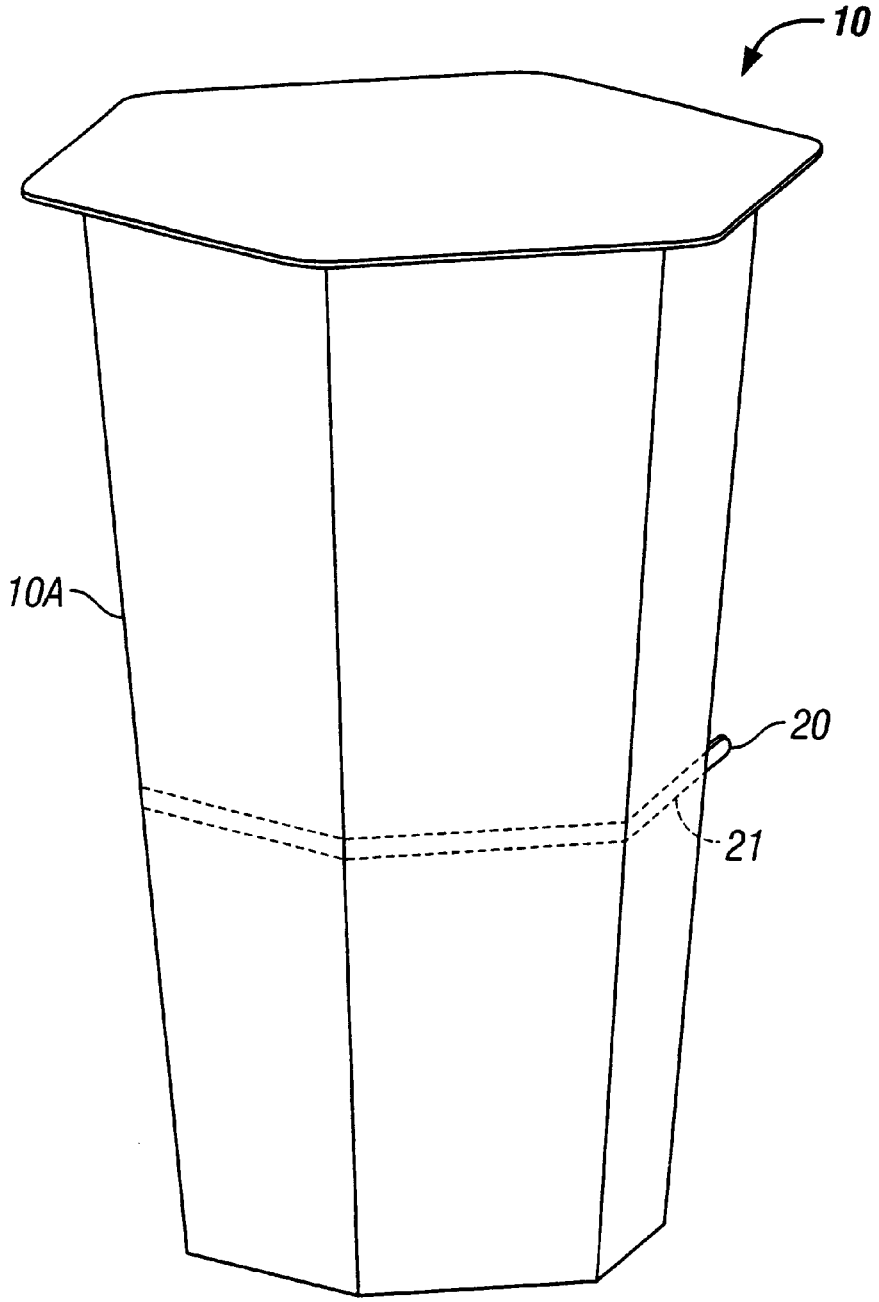
FIG. 1A and FIG. 1B illustrate a container comprising the tear-strip in alternative locations of the present invention.

It is readily apparent to one skilled in the art that various embodiments and modifications can be made to the invention disclosed in this Application without departing from the scope and spirit of the invention.

As used herein, the use of the word "a" or "an" when used in conjunction with the term "comprising" in the sentences and/or the specification can mean "one," but it is also consistent with the meaning of "one or more," "at least one," and "one or more than one."

The present invention is directed to a hand held microwave appropriate container that is designed for single handed use and portability. A microwave appropriate container is one that does not melt, spark or deform during microwave use. A microwave appropriate container also retains it structure during microwave heating or cooking. The hand held container allows for heating and cooking the contents in the container by way of microwave energy. The hand held container is configured to provide the user with a cool surface for holding the container when using or eating the contents of the container, while the contents of the container remain hot. In one configuration of the container a thermal insulating material can provide the enclosed structure for food or other items. In other embodiments the thermal insulating material covers a portion or all of the surface of the container. In the present invention, the thermal insulating material is part of the structure of the inventive container and surrounds at least a portion of the container before, during and after the microwave heating or cooking process. This is an important aspect of the present invention because microwaveable packages and its contents can reach a temperature of up to 400° F. while in a microwave oven. The thermal insulating layer on the inventive container provides a cooler surface so that a user can hold the hand held microwave container immediately upon removal from a microwave oven. This is because the thermal insulating layer provides a lowered rate of heat transfer from inside the container to an outer surface of the container.

Referring now in more detail to the drawings, in which like numerals refer to like parts throughout several views, the container 10 for a food item 30 includes an easy open device including a tear-strip 21 which is connected to a gripping tab 20. The container 10 can include one or more components. The food item 30 may be any food that is fresh, frozen, or chilled and thereafter microwaved for human consumption. It is also envisioned that the food item 30 may be a pet food for consumption by a companion animal.

The microwaveable food container 10 can be formed from material that provides for a rigid, semi-rigid or flexible container. For example, the container 10 can be constructed using rigid, semi-rigid or flexible materials such as cardboard, pulp paper, pressed paper, corrugated paper, plastic, laminates, or other rigid, semi-pliable materials and flexible materials. In specific embodiments, the container 10 may comprise more than one component, for example, an outer component 110 and an inner component 120. A third component, such as outer packaging material or an additional inner component is also contemplated.

Figure 1B:
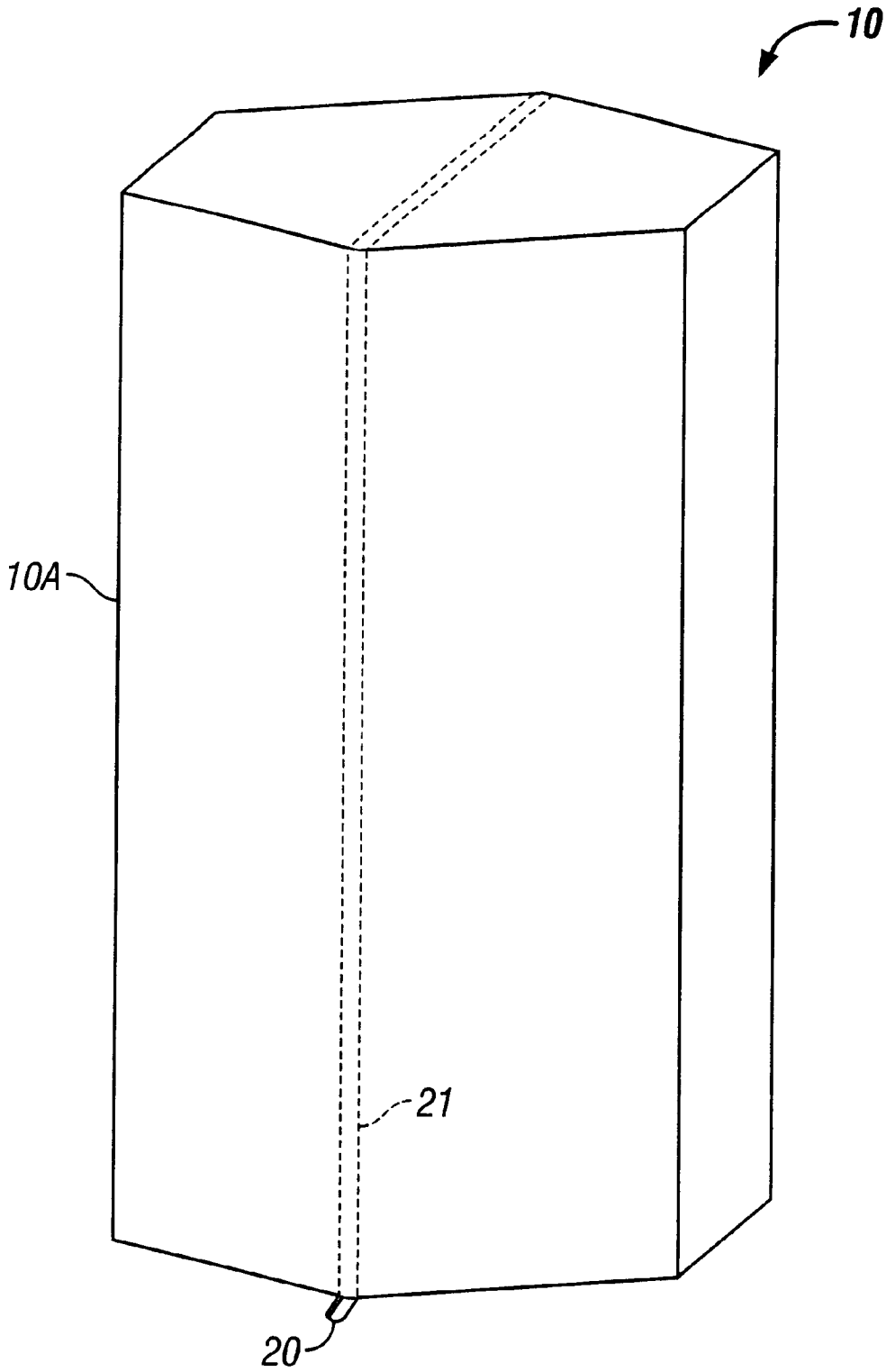
Figure 2A:
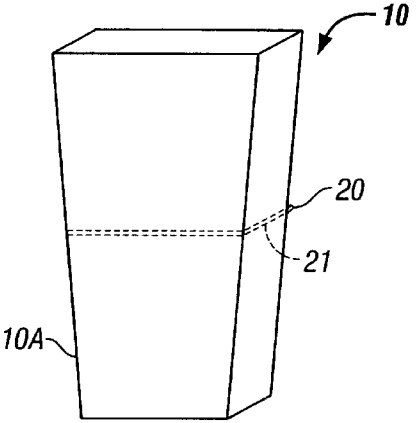
FIG. 2A, FIG. 2B, FIG. 2C, FIG. 2D, FIG. 2E and FIG. 2F illustrate a variety of possible shapes for the container of the present invention.
Figure 2B:
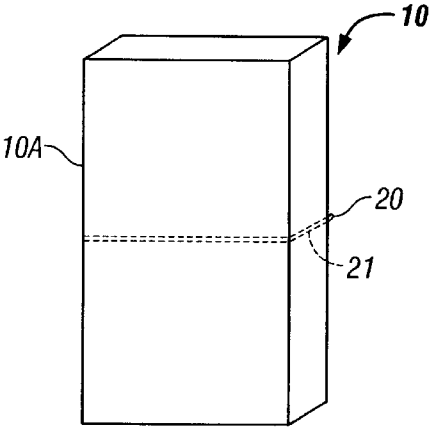
Figure 2C:
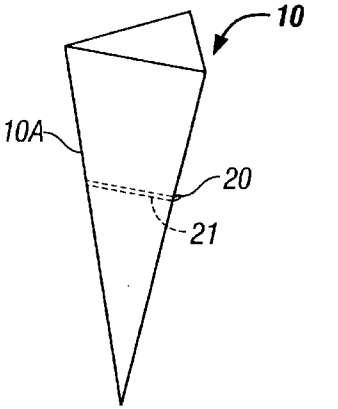
Figure 2D:
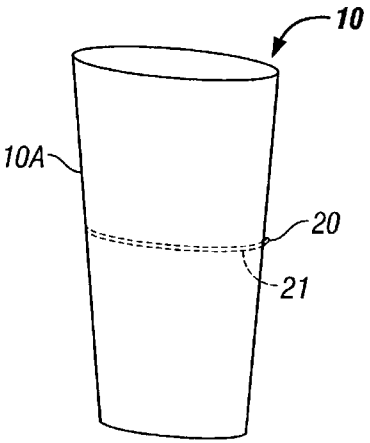
Figure 2E:
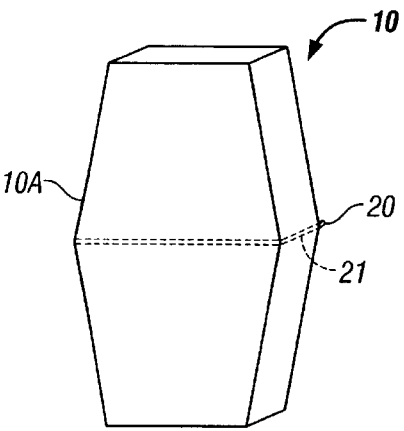
Figure 2F:
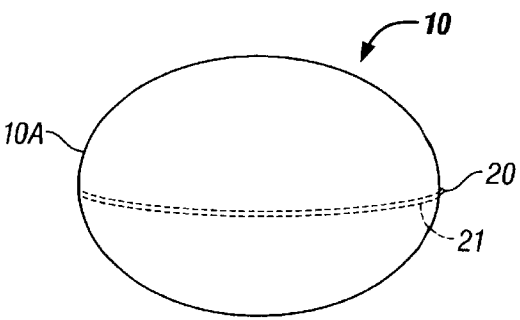

As shown in FIG. 1A and FIG. 1B the tear-strip 21 and gripper tab 20 can be positioned either horizontally (FIG. 1A) or vertically (FIG. 1B) around the food container 10. The present invention is not limited to the easy open feature of the tear-strip 21 and gripper tab 20, it is understood that other kinds of easy open mechanisms can be used. The tear-strip 21 and gripper tab 20 or any other easy open mechanism can be positioned at any location on the container in order to open the container such that an adequately sized container is provided that will perform as a receptacle for any given food item. It is also understood that the any easy open mechanism, including tear-strip 21, can wrap around the entire container or partially wrap around the container.

Figure 7A:
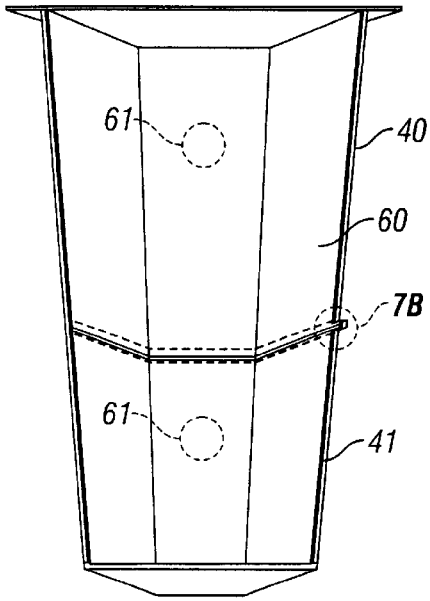
FIG. 7A and FIG. 7B illustrate a cross-sectional of the container and a detail of the tear-strip.
Figure 7B:
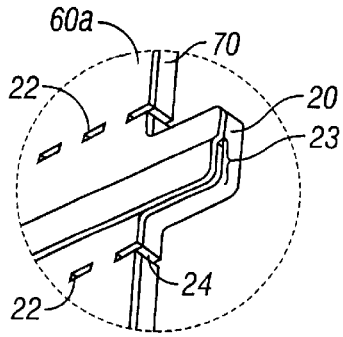

FIG. 7B shows a specific embodiment of the tear-strip 21 having stenciled markings 22 on the inner surface 60*a* of the substrate 60. The stenciled markings are perforation markings, which increase the ease of separating the container. In a preferred embodiment, the outside of the container can also contain a perforation marking 24.

Figure 8A:
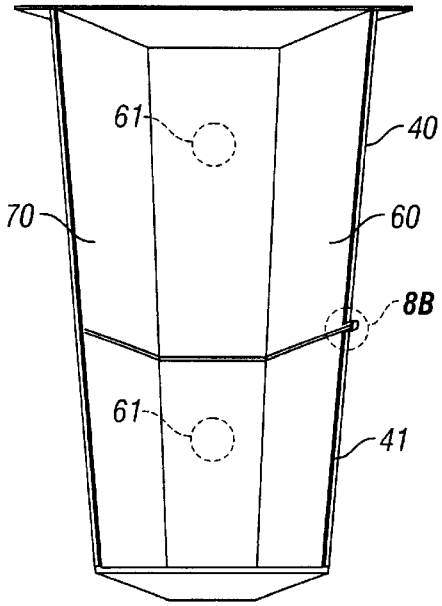
FIG. 8A and FIG. 8B illustrate a cross-sectional of the container and a detail of an alternate embodiment of a tear-strip.
Figure 8B:
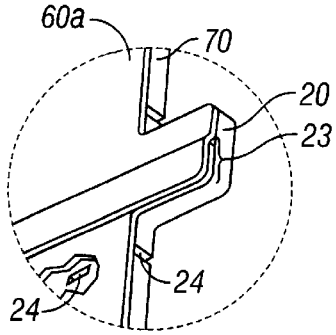

In an alternative embodiment, as shown in FIG. 8B, the tear-strip 21 only has perforations 24 on the outer surface of the container. Thus, the substrate 60, which is not perforated, tears or rips when the tear-strip 21 is pulled to separate the container.

Figure 9A:
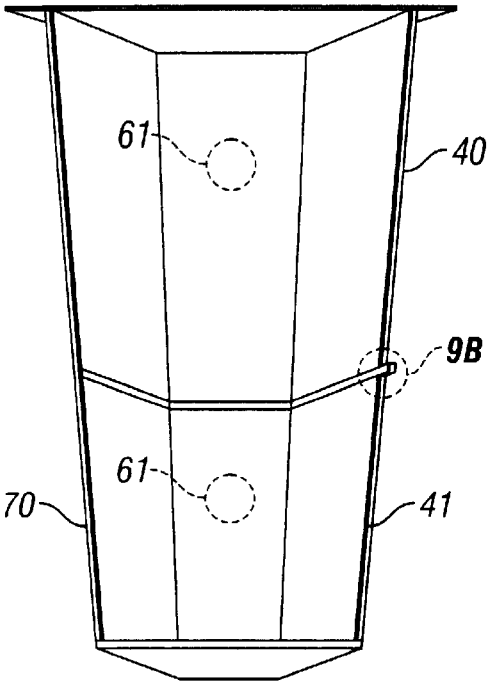
FIG. 9A and FIG. 9B illustrate a cross-sectional of the container and a detail of an alternate further embodiment of a tear-strip.
Figure 9B:
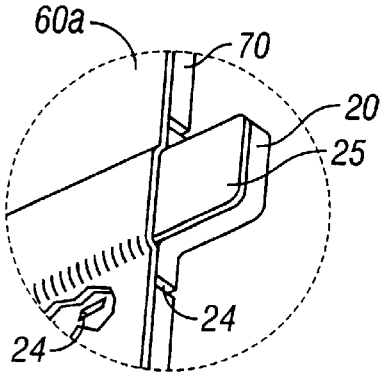

Another alternative is shown in FIGS. 9A and 9B. In this embodiment, the substrate on the inner surface 60*a* of the container includes a thread or strip 25 disposed or embedded within the substrate, which is also connected to a gripping tab 20 on the outside of the container. In a preferred embodiment, the outside of the container also contains a perforation marking 24.

FIG. 2A–FIG. 2F illustrates various shapes of containers that are contemplated in the present invention. Exemplary shapes include, but are not limited to an octagon, a hexagon, a polyhedron, a cylinder, a prism, sphere, ellipsoid, circular or egg-shaped, or a variant thereof or a pouch shaped container. As used herein, the term polyhedron refers to a solid object or a three-dimensional object bounded by polygons, which is a closed plane figure bounded by three or more line segments. A cylinder of the present invention refers to a solid bounded by two parallel planes with a surface having a circle as a directrix. Yet further, a prism of the present invention includes a solid figure whose bases or ends have the same size and shape, and are parallel to one another and each of whose sides is a parallelogram. A sphere of the present invention refers to a three-dimensional object that has all points equidistant from a fixed point. An ellipsoid of the present invention relates to an object having plane sections that are either ellipses or circles.

Figure 3A:
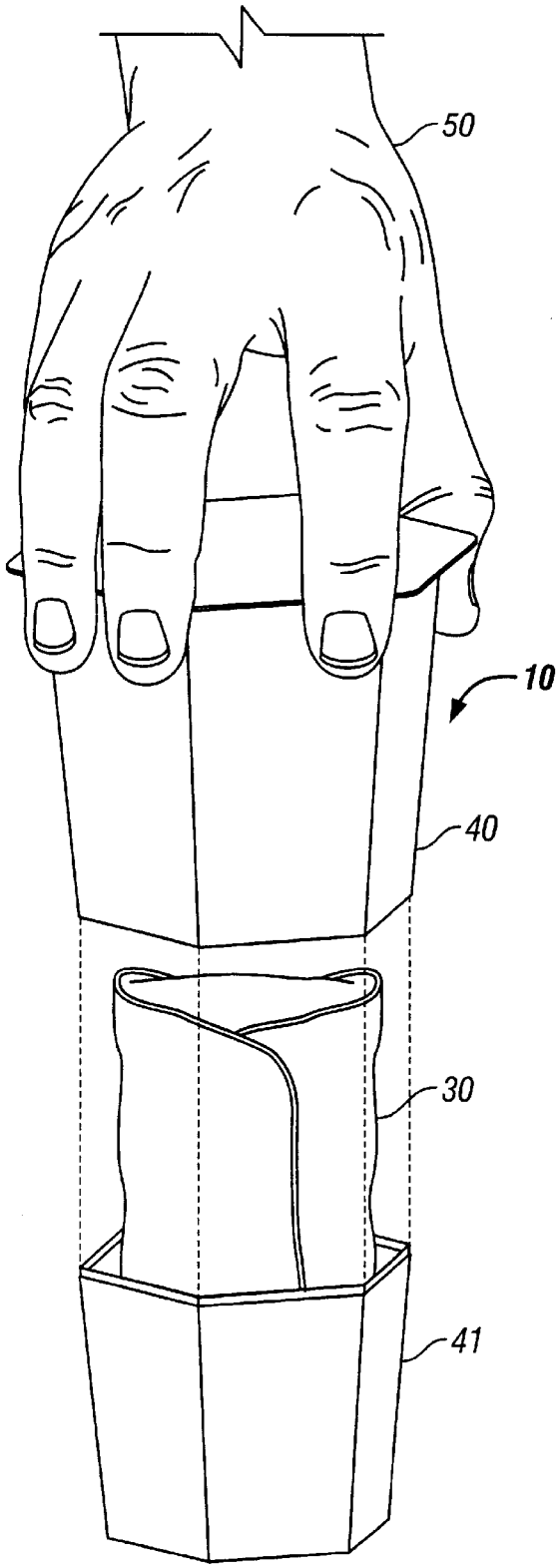
FIG. 3A and FIG. 3B illustrate the container in an open position in which the container is separated into two parts.
Figure 3B:
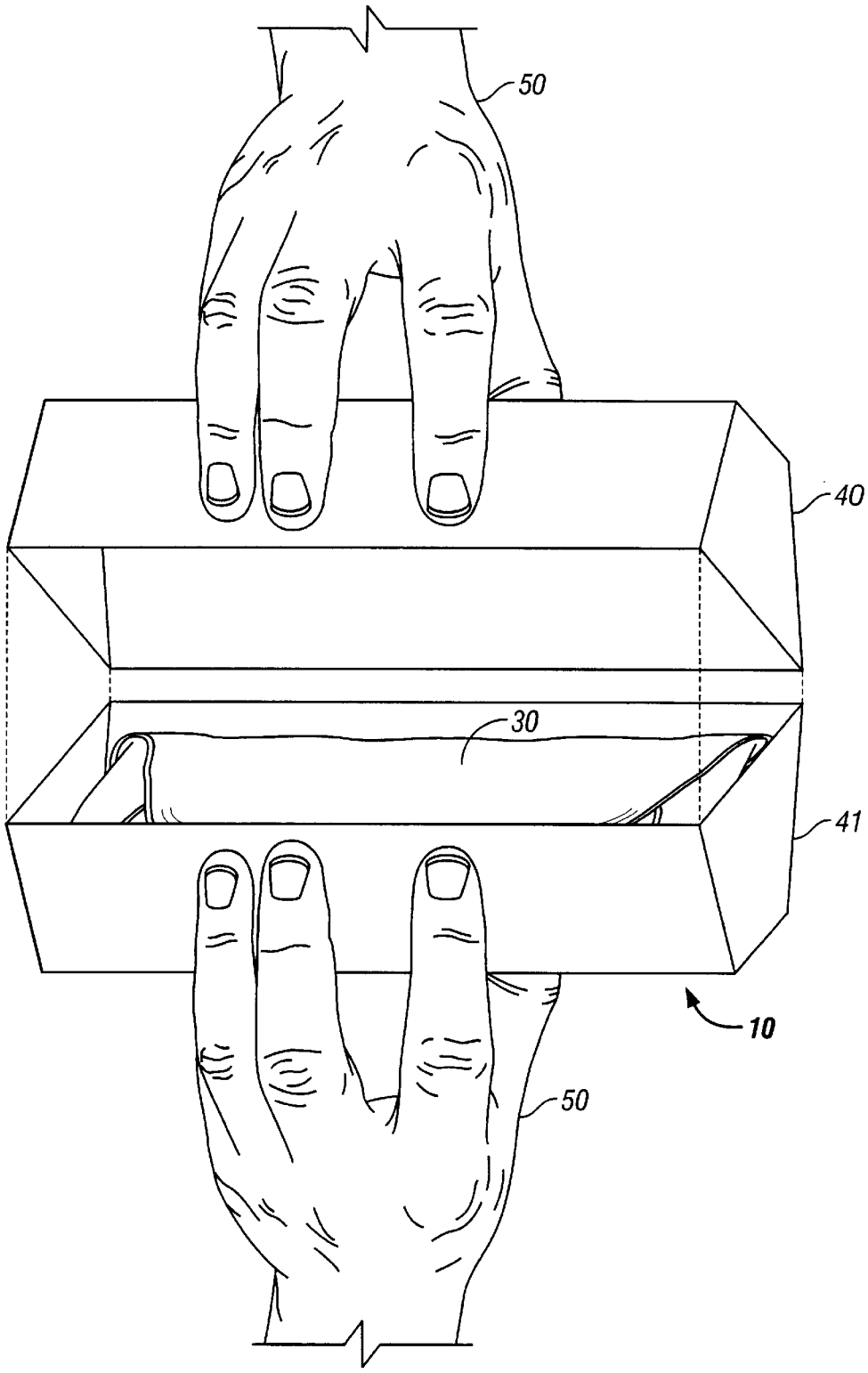
Figure 4:
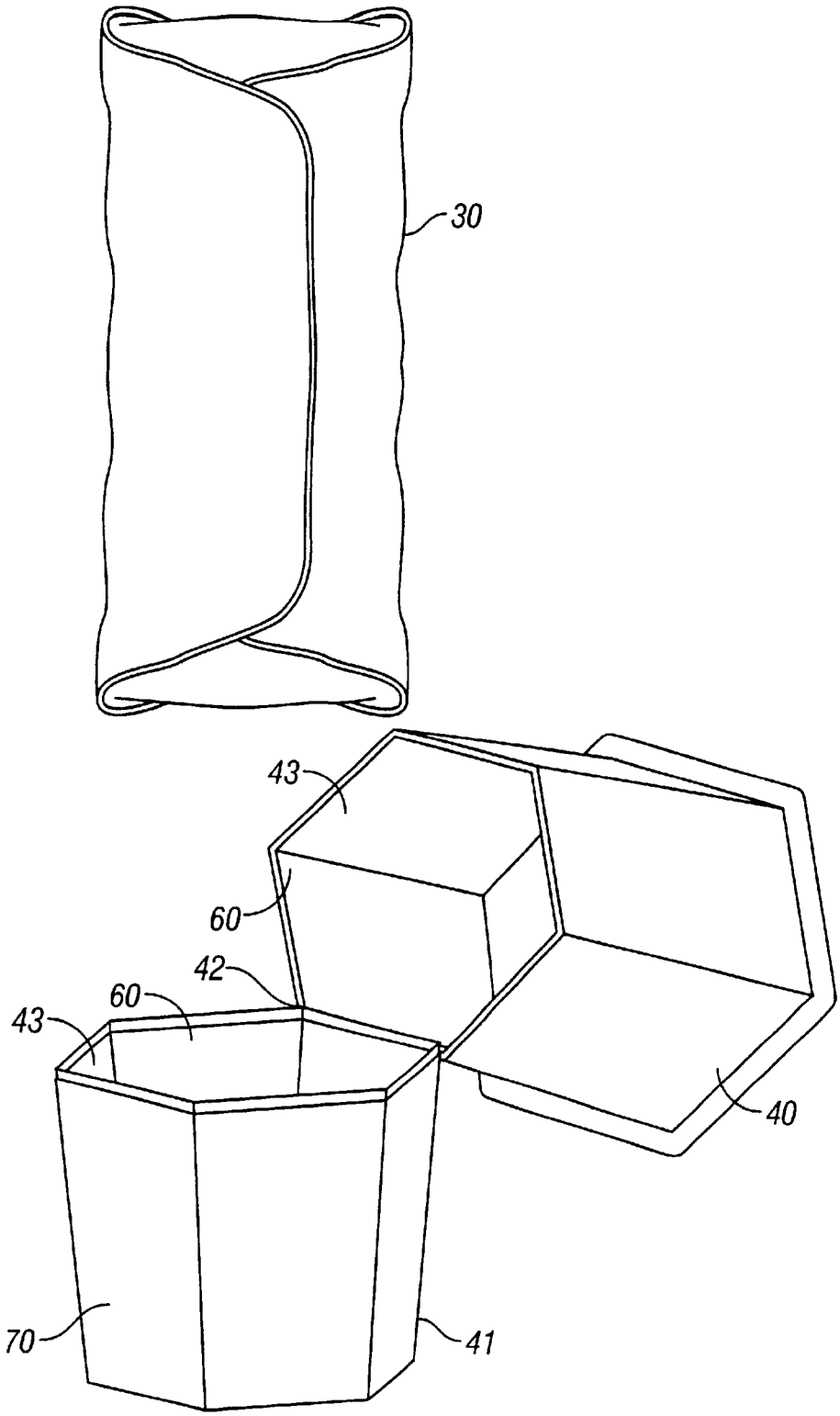
FIG. 4 illustrate the container in an open position in which the container is not separated into parts.

Referring to FIGS. 3A, 3B and FIG. 4, the food container, 10 containing a food item 30 of the present invention, can be separated into two parts 40, 41. The separation of the container 10 occurs via a tear-strip 21 of which is positioned horizontally or vertically on the container. The tearing action results in a separation of the container into two parts 40, 41. Complete separation is not essential. In fact, the container may only be partially separated having an opening 43 and a hinged section 42 to allow the consumer to use both portions of the container 10 for receptacles of food items or other items, such as condiments.

Figure 5A:
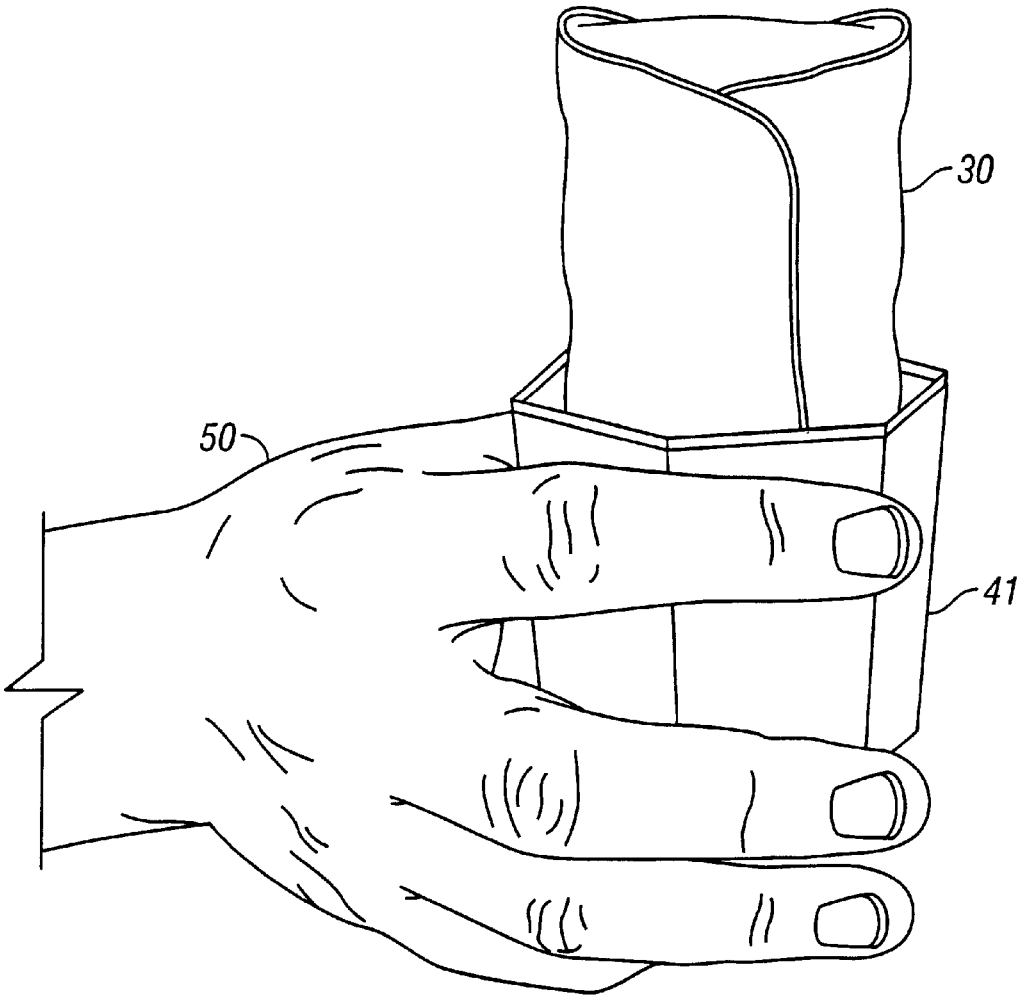
FIG. 5A and FIG. 5B illustrate that the container can be held by one hand for consumption.
Figure 5B:
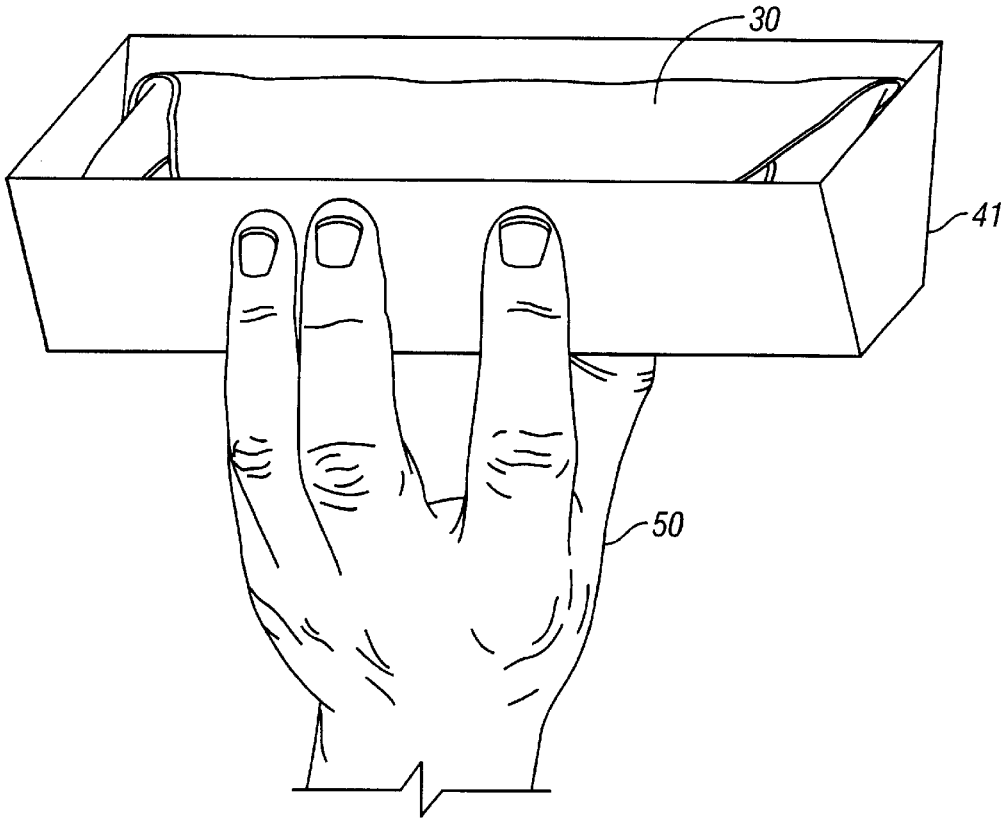

As shown in FIG. 5A and FIG. 5B, the present invention is designed to be held in one hand 50 while eating the food item. For example, the consumer microwaves the container having a food item, tears open the container and removes the top part 40, and holds the bottom part 41 of the container to consume the hot food item. The benefit of the present invention is that the consumer does not have to wait for the container to cool before it can be held because of the thermal insulating surface on the container. In fact, the container can be removed immediately from the microwave oven and held in one hand without burning the hand of the consumer.

Figure 6A:
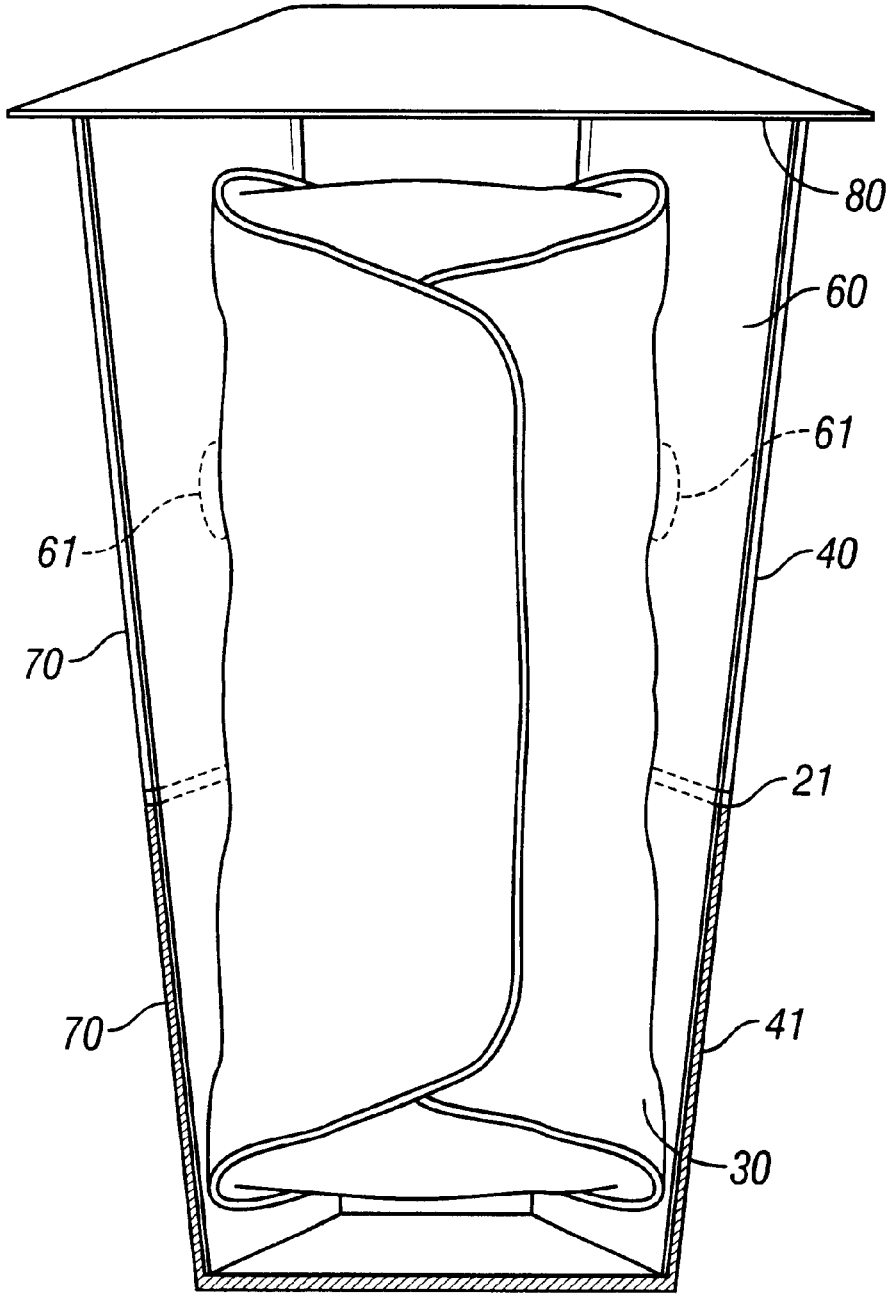
FIG. 6A and FIG. 6B illustrate a cross-sectional of the container.
Figure 6B:
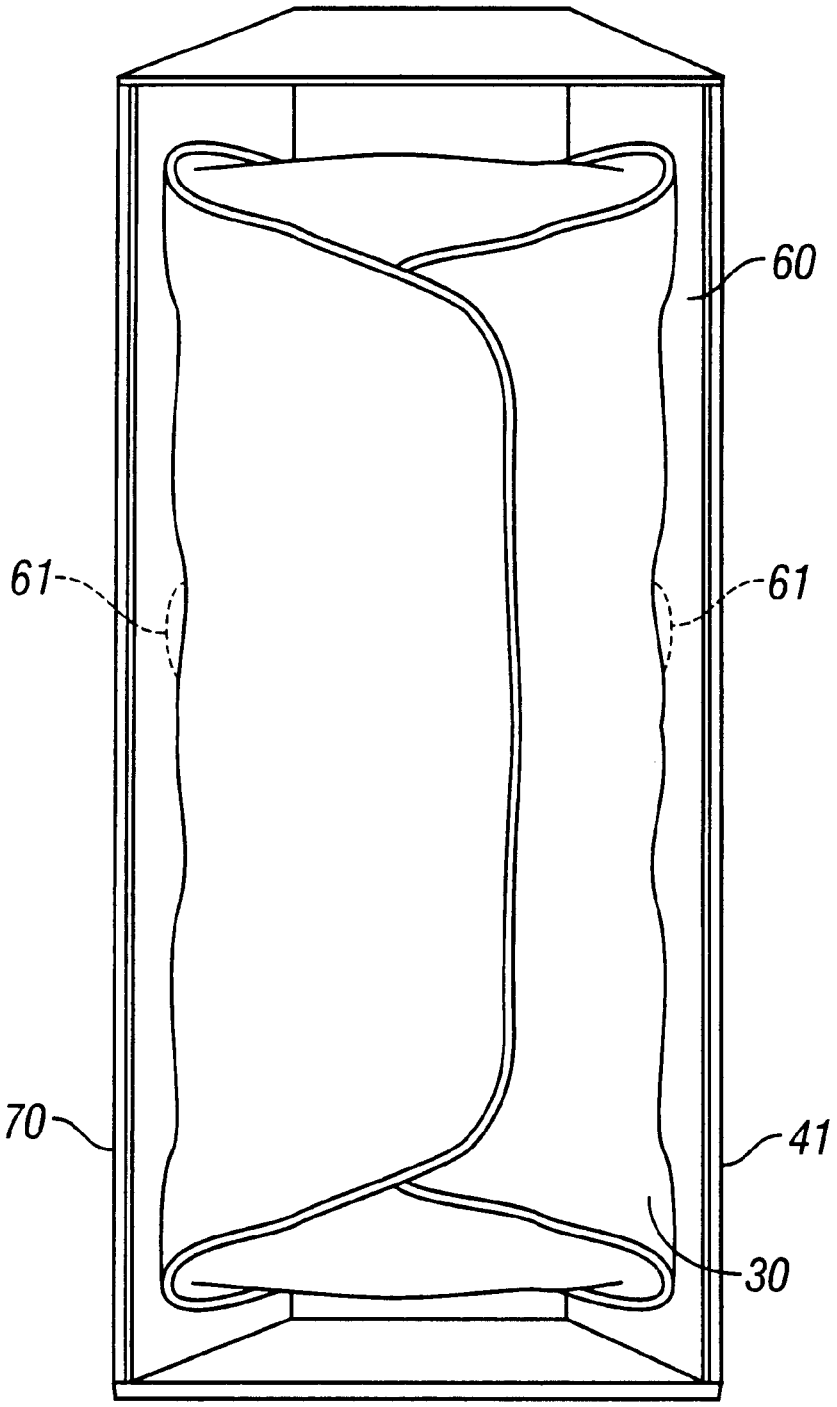

Referring to FIGS. 6A and 6B, the present invention is contemplated to be a microwaveable food container. It is known in the art that microwaveable containers contain a designed weakness in a seal 80 of the container that ruptures and vents the container when hot gases within the container cause an interior pressure and/or cause the pressure to exceed a desired level or temperature. As is well known to those skilled in the art, as the pressure inside the sealed container 10 rises, the temperatures of vapors inside the sealed container 10 also rises. Typically, a number of vents 61 are positioned on the container which rupture and vent the container during microwave oven use (FIGS. 7A, 8A and 9A).

Figure 10A:
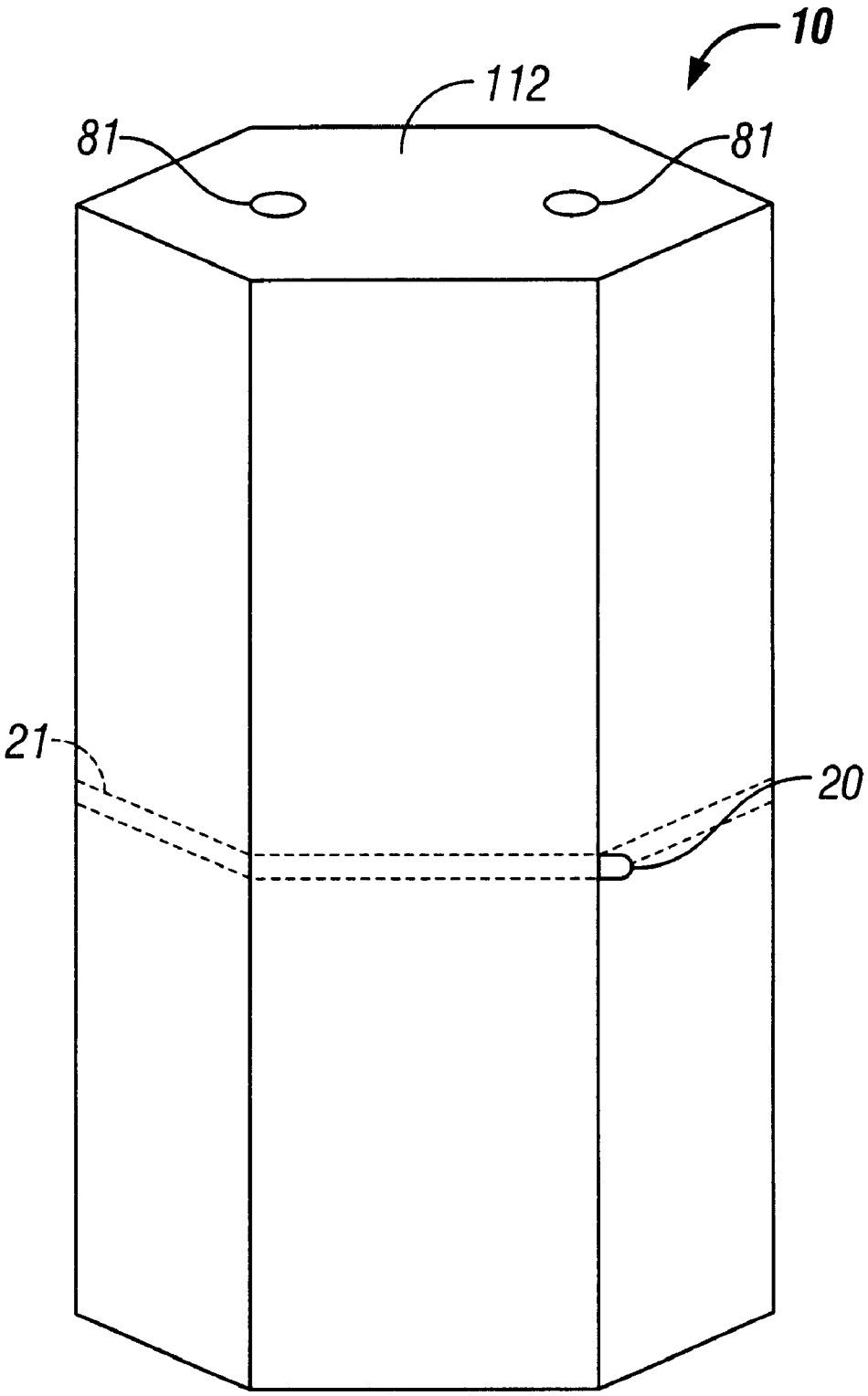
FIG. 10A and FIG. 10B illustrate an embodiment of a container having an alternative venting mechanism.
Figure 10B:
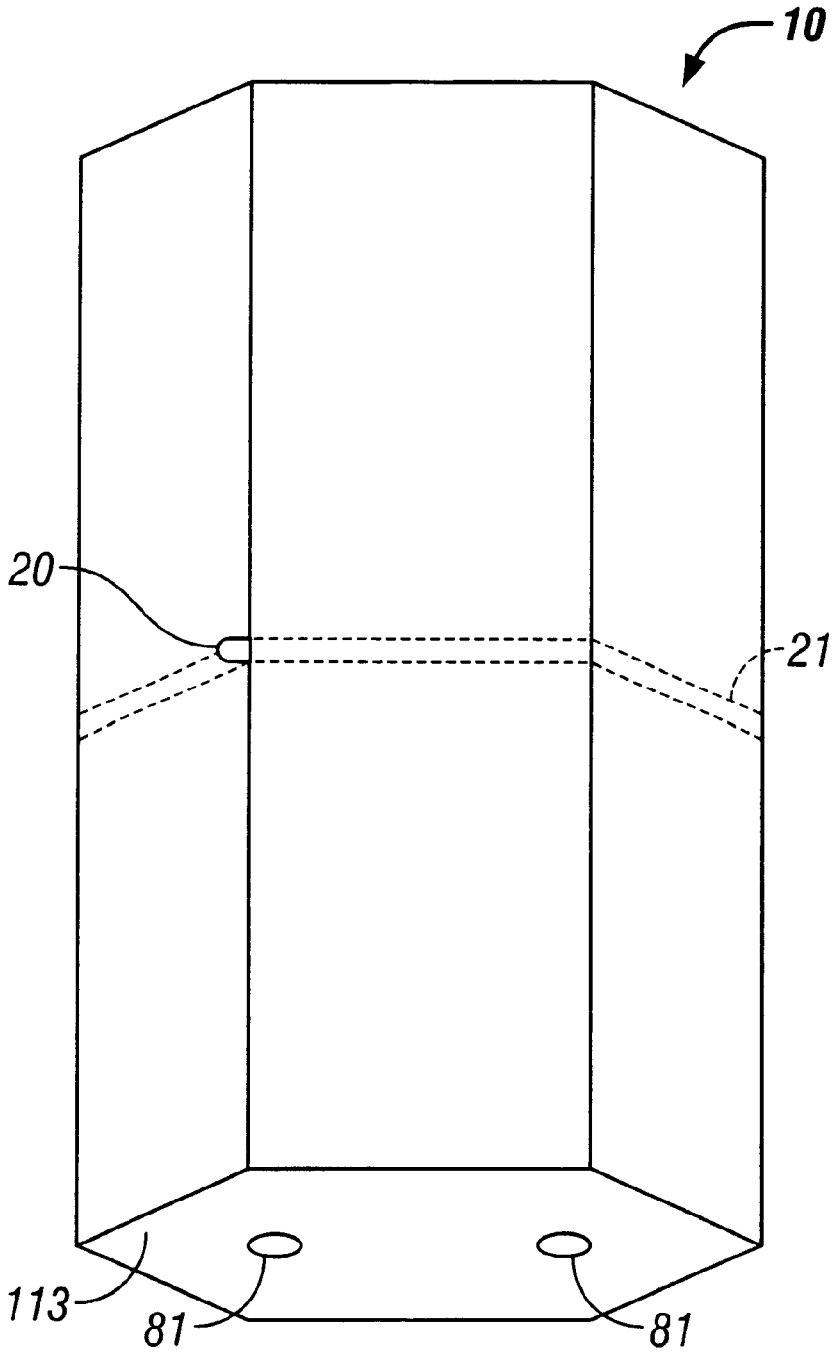

FIGS. 10A and 10B illustrate an alternative venting mechanism of the container 10. In this embodiment, the container 10 includes at least one hole 81 in the top 112 of the container, which serves to vent the container. The vent 81 may be formed in the dye cut of the container 10 or may be mechanically made by the consumer prior to inserting the container into the microwave. Additionally, multiple holes, i.e., two or more, may be used to vent the container. The use of at least one vent 81 or hole on the top 112 of the container and one vent 81 on the bottom 113 of the container creates a chimney effect (FIG. 10B). The chimney effect allows the air to circulate through the container 10 during the cooking/heating process.

Preferably, either the outer or inner component 110, 120 includes a venting mechanism. For example, a flexible inner component 120 (pouch 120A) can include seals that self-vent at the top and bottom of the pouch. In a specific embodiment, the inner component 120 can include a self-vent seal at the top of the pouch 120A and a non-self-venting seal at the bottom of the pouch 120A. The non-self-venting seal at the bottom of the pouch prevents the food item from leaking or spilling into the outer component 110. Alternatively, the inner component 120 can be designed so that steam is channeled directly out of the container 10 and does not come into contact with the outer component 110. Alternatively, a seal in either the outer or inner components 110, 120 can be manufactured to fail under certain pressure and/or temperature conditions. In another embodiment, the container 10 or outer component 110 can include one large vent in which the container is opened by punching open the vent in which the punched-out vent remains attached to the container 10 by a hinge. All embodiments of the subject invention preferably include a means for venting of steam in either or both the outer and inner component 110, 120.

Microwaveable containers can also contain a microwave susceptor surface 60 positioned as an inner surface of the container. The susceptor surface is a substrate having a microwave-absorptive coating region that is typically adjacent to the food item.

The susceptor 60 of the present invention is formed from a substrate upon which a coating for absorption of microwave radiation is deposited, printed, extruded, sputtered, evaporated, or laminated. The susceptor 60 may include a pattern that is specific for a particular food item in order to heat the food item evenly. Various patterns include, but are not limited to square matrix, shower flower, hexagonal, slot matrix and or concentric circles. See U.S. Pat. Nos. 6,251,451; 6,114,679; 5,698,127; 5,038,009; 6,133,560; and 6,150,646 which are incorporated herein by reference. It is also envisioned that the substrate may include a second coating for reflection of a portion of the microwave radiation to which the susceptor is exposed. By varying the reflectivity of coating, a membrane is created which is selectively permeable to microwave energy—i.e., it has the ability to control the amount of microwave energy reaching the absorbing coating. It is also envisioned that the substrate may comprise a third coating for shielding. Any method for applying microwave absorbing and reflecting coatings can be used, provided the method does not damage the substrate upon which the coatings are being deposited during the deposition process. See U.S. Pat. Nos. 5,254,821, and 5,038,009, which are incorporated herein by reference. Thus, as used herein, the term susceptor 60 refers to a substrate having a microwave-absorptive layer, a shielding layer, a reflective layer, or any combination thereof to produce the desired heating requirements for any given food item. One such combination includes a single coating having a microwave-absorptive ability, reflective abilities and shielding abilities. Yet further, the susceptor is variable in design depending upon the container type or shape.

The substrate preferably comprises an electrical insulator, e.g., a polymeric film. Materials considered to be useful as the substrate include, for example, but are not limited to polyolefins, poly-esters, polyamides, polyimides, polysulfones, polyether ketones, cellophanes, and various blends of such materials. Other non-conducting substrate materials such as paper and paper laminates, silicates, and cellulosics can be used as well.

A variety of electrically conductive materials can be used for the absorbing coating, for example, a single metal, a metal alloy, a metal oxide, a mixture of metal oxides, a dispersion of conductive metallic or non-metallic materials in a binder, or any combination of the foregoing. Suitable exemplary metals include aluminum, iron, tin, tungsten, nickel, stainless steel, titanium, magnesium, copper and chromium. Suitable exemplary metal oxides include oxides of aluminum, iron, and tin, however, if not electrically conductive, they must be used in combination with an electrically conductive material.

Generally, the conductive materials are suspended or dispersed into a vehicle to allow for ease of coating the substrate. Suitable exemplary dispersion materials include carbon black, graphite, powdered metals, and metal whiskers. In a preferred embodiment, the absorbing coating is suspended in an appropriate vehicle having the viscosity necessary for proper transfer in a press inking system. This combination is also referred to as susceptor ink.

It is also contemplated that the susceptor include a selectively permeable reflecting coating or laminate. Examples of such coatings or laminates include, but are not limited to metals or metallic alloys, oxides or mixtures thereof either alone, or as a dispersion in a binder.

The microwave shielding layer attenuates microwave energy to spread microwave transmission more evenly within the container 10, and minimizes contact of microwave energy with the food item 30. Suitable metallized microwave shielding materials are disclosed in U.S. Pat. No. 5,300,746, which is incorporated herein by reference.

The present invention also includes a thermal insulating material to protect the food item and/or to protect the consumer from the hot food item. The thermal insulating material is positioned outside the susceptor 60 and may cover the entire container or only a portion of the container. Thus, the container can be fully insulated to protect the food item from thawing pre-maturely or warming pre-maturely. Alternatively, the container can be partially insulated, for example as shown in FIGS. 5A, 5B, in which the portion of the container held by the consumer is insulated to protect the consumer from being burned when holding the container.

Suitable materials for the thermal insulation preferably include materials that are capable of being stored and handled at temperatures typical for frozen and/or chilled foods that can also be cooked in the package or container and materials that can be stored and microwaved. Microwave appropriate thermal insulating material provides a lower rate of heat transfer from the heated or cooked item in the container to the outer surface of the container before, during and after microwave heating or cooking; may allow for active cooling of the outside surface of the container; and/or provides for decreased surface contact with the hot microwaved container. One such material that may be used is a thermoplastic synthetic resin. See U.S. Pat. No. 4,435,344, which is incorporated by reference. Other materials include for example, cardboard, pulp paper, pressed paper, corrugated or fluted paper or board such as micro fluted board with E, F, B, or C shaped flutes, or single or double faced fluting in which the flutes are facing either in or out, in which these materials have a low moisture content. Alternatively, these materials can be coated or laminated in order to prevent moisture absorption. Also included is embossed paper, polystyrene foam, polypropylene foam, polyethylene terephthalate foam, or other similar types of plastic foam and poly-ester in any form. The thermal insulating surface 70 can be adhered to the container 10 using adhesives well known to those skilled in the art of packaging.

Figure 11:
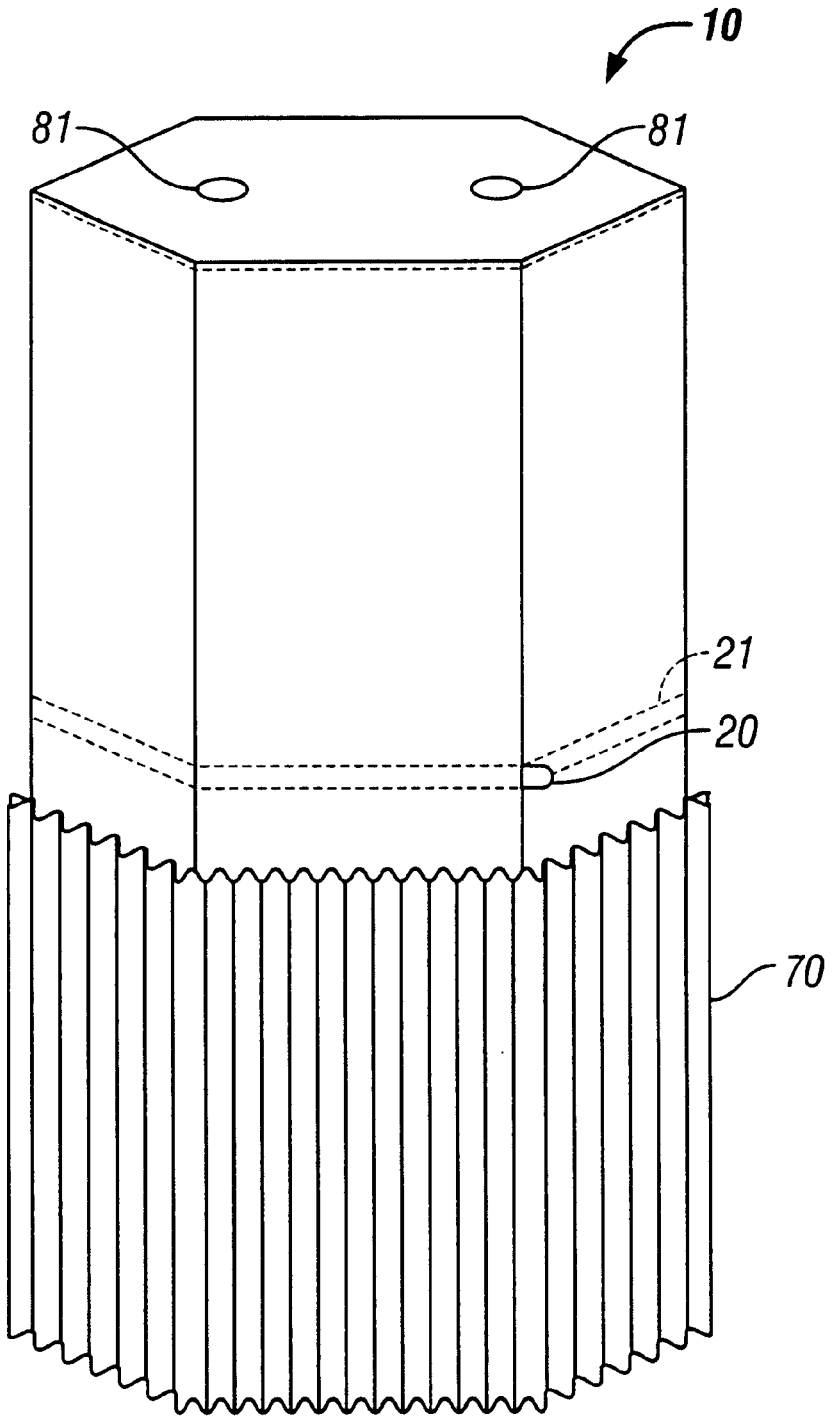
FIG. 11 illustrates an embodiment of the container having a thermal insulating sleeve positioned around the container.
Figure 12:
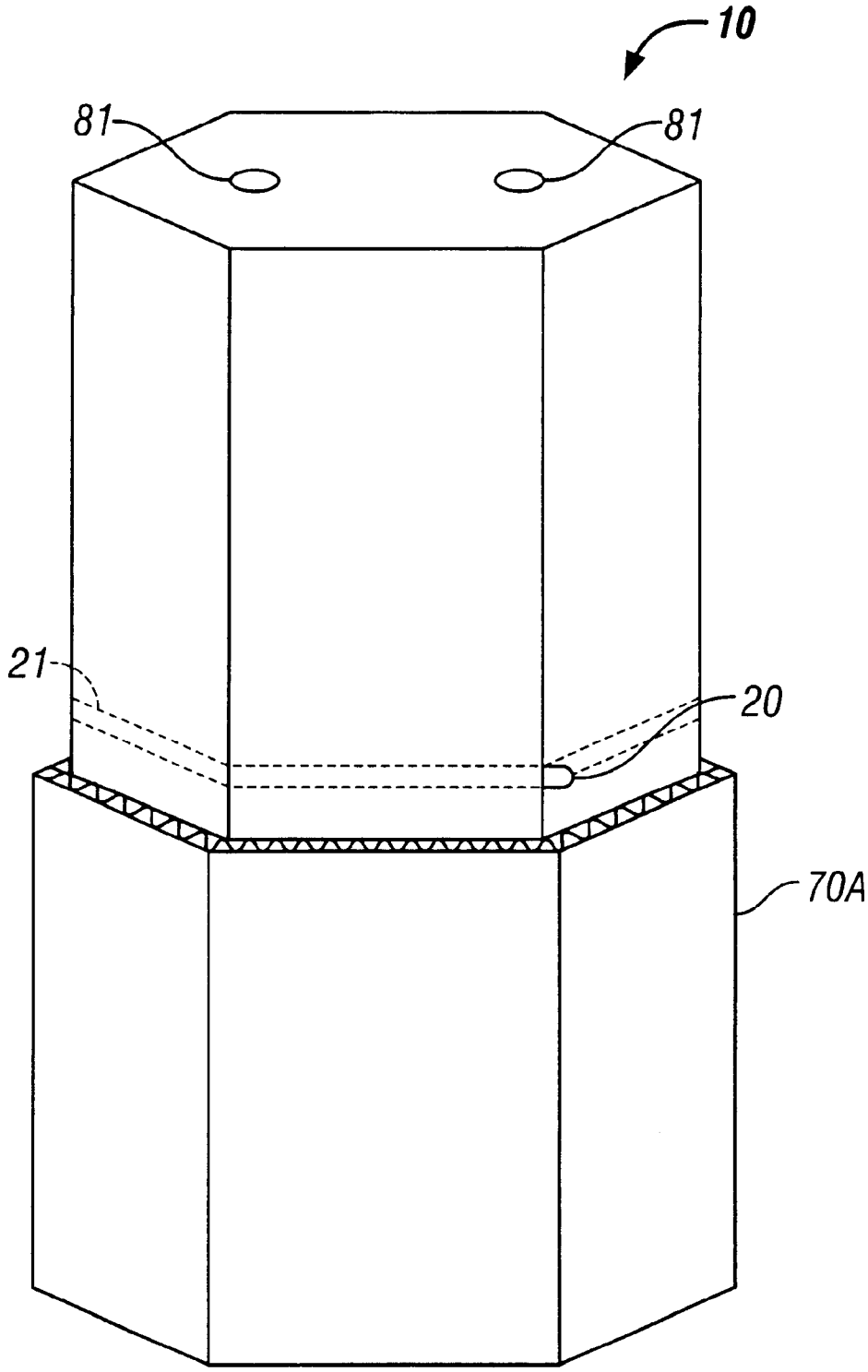
FIG. 12 illustrates the container of FIG. 11 having an alternate embodiment of a thermal insulating sleeve positioned around the container.
Figure 13:
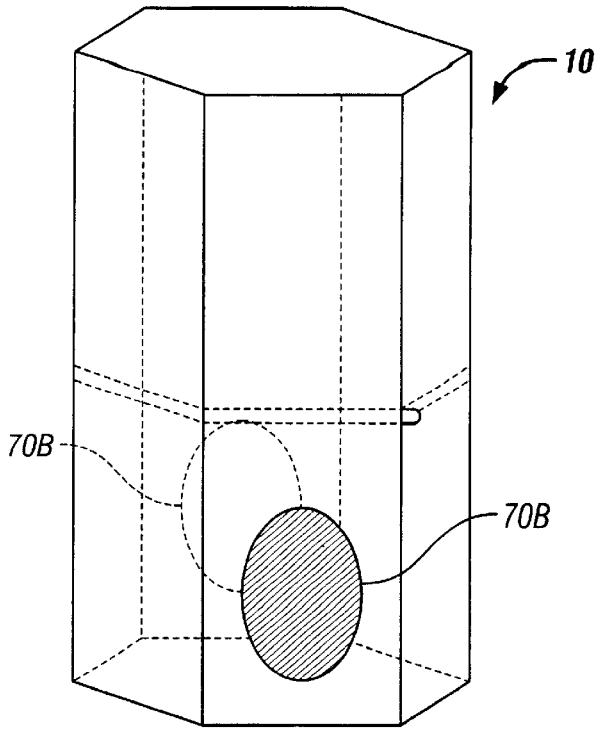
FIG. 13 illustrates an embodiment of the container having thermal insulating pads positioned on an outer surface of the container.
Figure 14:
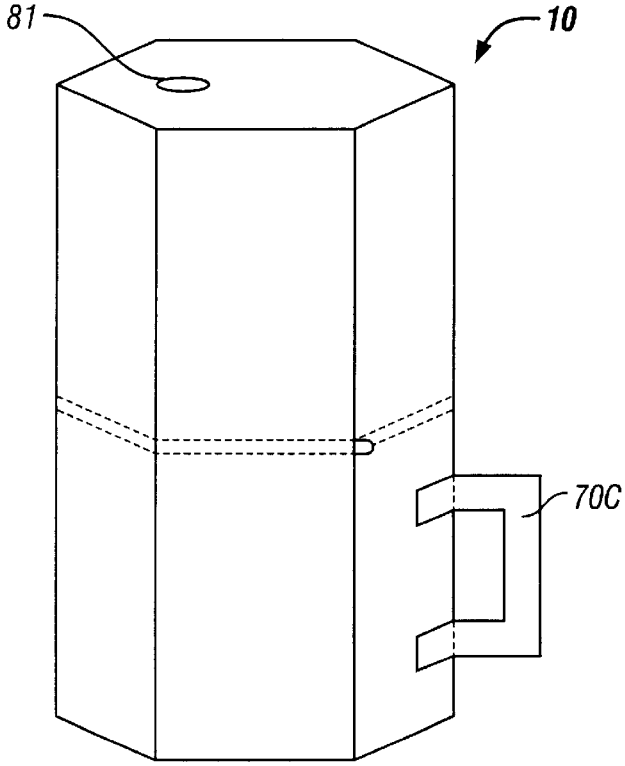
FIG. 14 illustrates an embodiment of the container having a thermal insulating handle positioned on an outer surface of the container.

The thermal insulating surface can be positioned in a variety of places within or outside the container 10. For example, the thermal insulating surface 70 can be positioned on the outside of the container 10 (FIGS. 11–14). The outside of the container can be coated or laminated with a thermoplastic synthetic resin film or any other known thermal insulating material such as fluted board can be attached to the surface of container 10. It is envisioned that the thermal insulating layer may cover the entire outside of the container or only a portion of the container, for example, such as part 41, in order to provide a non-heated area of the container 10 for holding by a consumer. The thermal insulating material 70 can surround the entire bottom half of the container or only a portion of the container 10. FIG. 11 illustrates a thermal insulating surface 70 formed from a fluted board. FIG. 12 illustrates a thermal insulating surface 70A formed from a fluted board placed between an inner and outer layer of cellulose material. FIG. 13 illustrates the thermal insulating surface 70 positioned appropriately for the placement of the consumer's thumb or fingers creating specific insulated pads or areas 70B. Alternatively, a fold-out handle 70C or wings formed of the thermal insulating material can be attached to the outside surface of the container (FIG. 14). All of the described embodiments can include areas or pads 70B of thermal insulation or a layer of thermal insulation 70, 70A on all or portions of the surface of the outer component 110.

Alternatively, the thermal insulating material may be on the inside of an outer component 110 or the container 10, such that the thermal insulating material is positioned between the wall of the container or outer component and the susceptor. The thermal insulating surface may be such that the thermal insulating surface is positioned between the wall of the container and the susceptor 60. Yet further, the container or the outer component itself may be formed using a thermal insulating material in which the insulating material provides structure to the container. The thermal insulation allows the user with a cool surface for holding the container and eaten the contents of the container, while keeping the contents of the container hot.

The addition of the thermal insulating material or layer to the hand held container is an important feature of the inventive container. As discussed above, microwaved packages and its contents can reach temperatures up to 400° F. during microwave oven use. The addition of the thermal insulating material or layer allows for a microwaved container to have a comfortable temperature for holding a container of microwaved cooked/heated food in a user's hand while eating the food item. This is because the thermal insulating material on the container 10 provides a lower rate of heat transfer from the cooked food item to the outer surface of the container 10, which prevents the outer surface of the container from reaching the temperature of the food item contained within the container. Thus, the thermal insulating layer on the inventive container provides a cooler surface so that a user can hold the hand held microwave container immediately upon removal from a microwave oven.

The materials of the outer component and inner component 110, 120 can be interchangeable. For example, the outer and inner components 110, 120 can be constructed using rigid, semi-rigid or flexible material. For example, ridged material can include injection molded plastics, thermoformed plastics, thermoformed polyethylene terephthalate, injection molded polyethylene terephthalate, paperboard, laminate paperboard, laminated molded pulp, single side fluted board, double side fluted board, corrugated board, embossed paperboard. Semi-ridged material can include for example, paperboard, corrugated board (micro-flute, E, F, C or B shaped flute or any other fluted board), paperboard canister, plastic sheeting such as polyethylene terephthalate (PET). The paperboard could be laminated with a number of films such as susceptor film, PET, polypropylene. These materials can also be coated or laminated in order to prevent moisture absorption. Any form of polyester would also be suitable as a semi-rigid or flexible material.

The flexible material suitable for microwaving only can include polyethylene terephthalate film or sheets, polypropylene film or sheets, foamed polypropylene, and foamed polyethylene terephthalate. Flexible material suitable for microwaving with susceptors can include paper/polyethylene terephthalate/susceptor laminate, cellophane/polyethylene terephthalate/susceptor laminate, polyethylene terephthalate/susceptor film, aluminum foil, and paperboard/PET/susceptor laminate. A preferred material for a flexible pouch with a susceptor would be paper/PET/susceptor films or sheets.

Figure 15A:
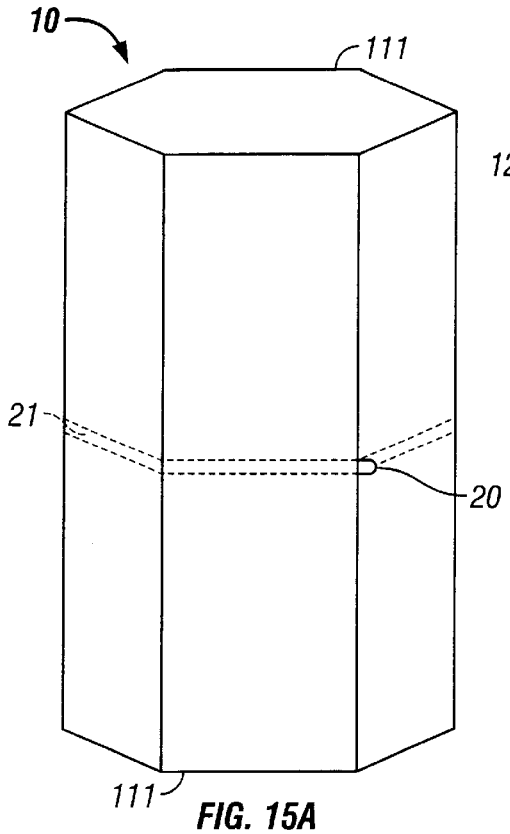
FIG. 15A, FIG. 15B and FIG. 15C illustrate an alternative embodiment of the container having two components.
Figure 15B:
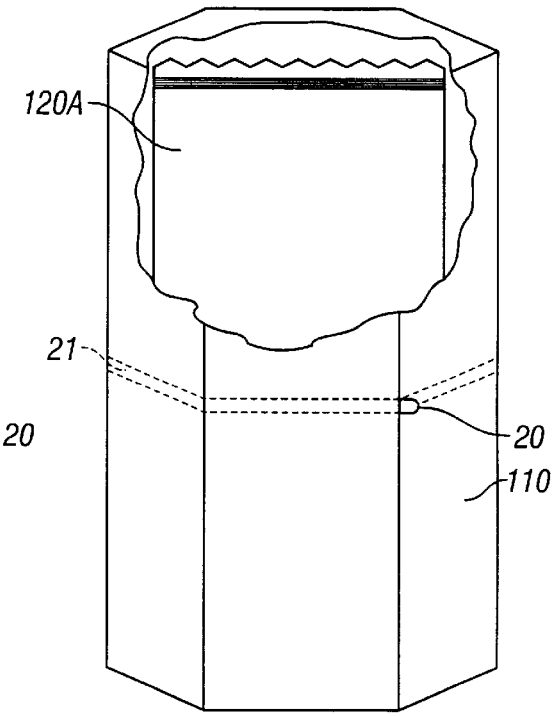
Figure 15C:
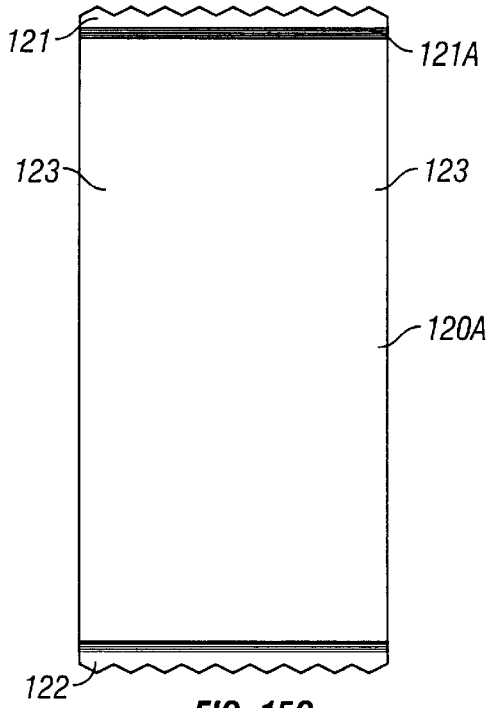

In one embodiment of the present invention the container 10 includes two components, an outer component 110 and an inner component 120 (FIGS. 15A, 15B and 15C). The outer component 110 can be a closed container having at least two sides 111, a top 112 and a bottom 113. In this embodiment the outer component 110 is constructed of semi-rigid material, i.e., corrugated paper and the inner component 120 is constructed of flexible material in the shape of a pouch 120A.

The pouch 120A (FIG. 15B) includes a top 121, a bottom 122 and coplanar sides 123. The top 121 and bottom 122 sides have transverse seals. The pouch 120A is sealed using standard techniques that are well known and used in the art of packaging. A horizontal heat seal 121A can extend along the top 121 and/or bottom 122 of the pouch to complete the sealing of the pouch. All flexible films can be made heat sealable with coatings or co-extrusion or naturally sealable (oriented & cast polypropylene or LDPE) material. The pouch 120A can be formed using a processing line configured for the formation of pouches from a heat sealable, continuous plastic film as is known to one skilled in the art of forming pouches.

Figure 16A:
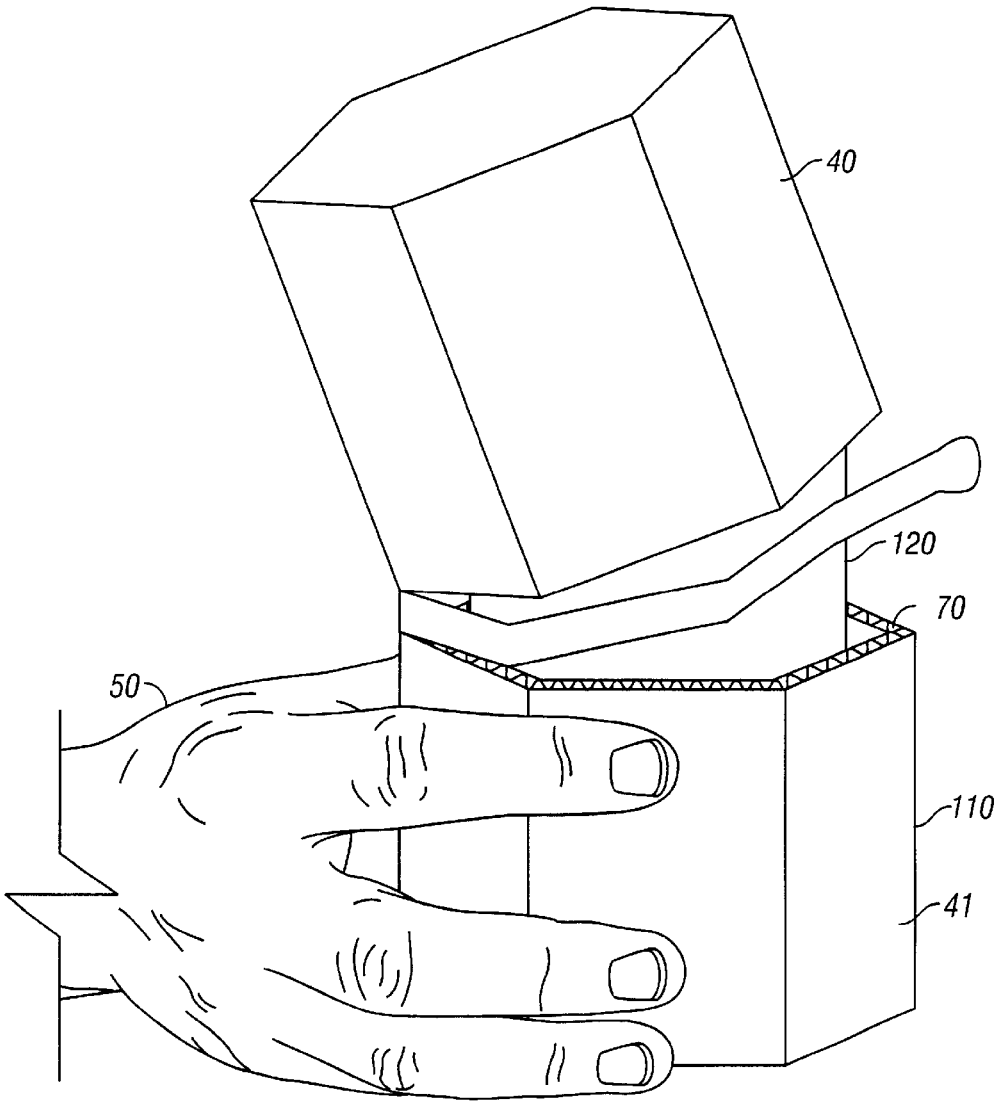
FIG. 16A, FIG. 16B and FIG. 16C illustrate opening a container having two components.
Figure 16B:
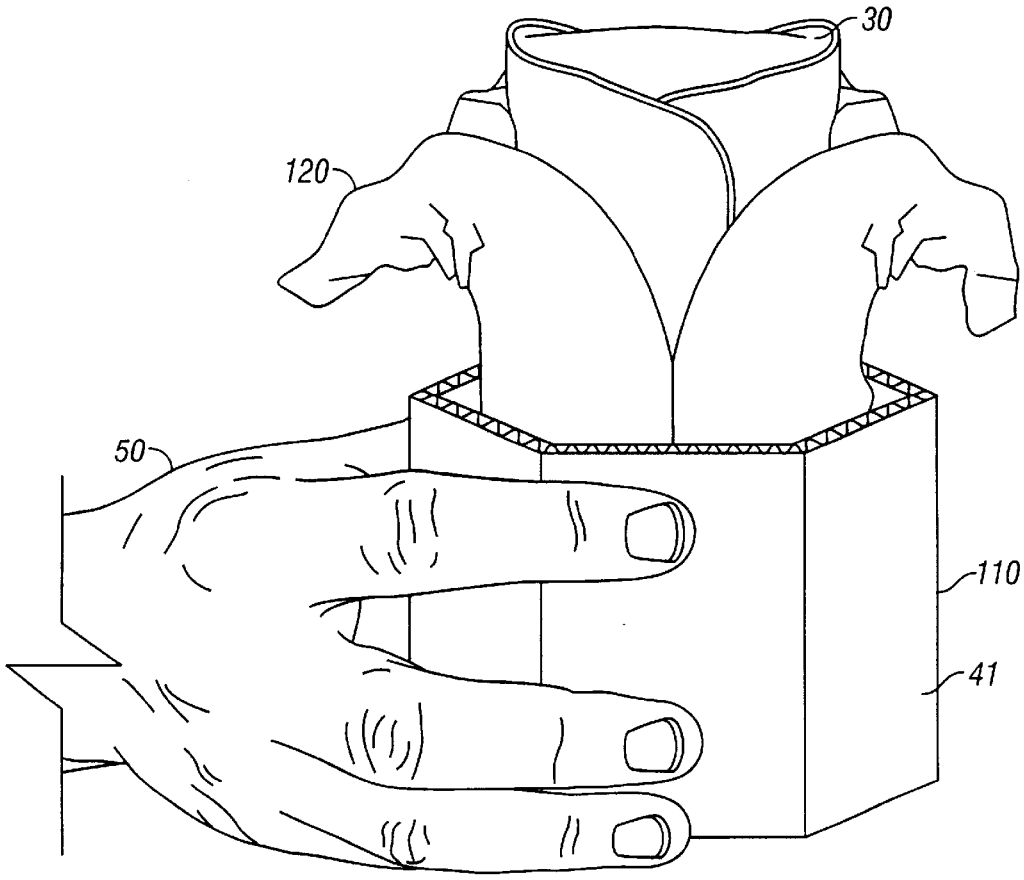
Figure 16C:
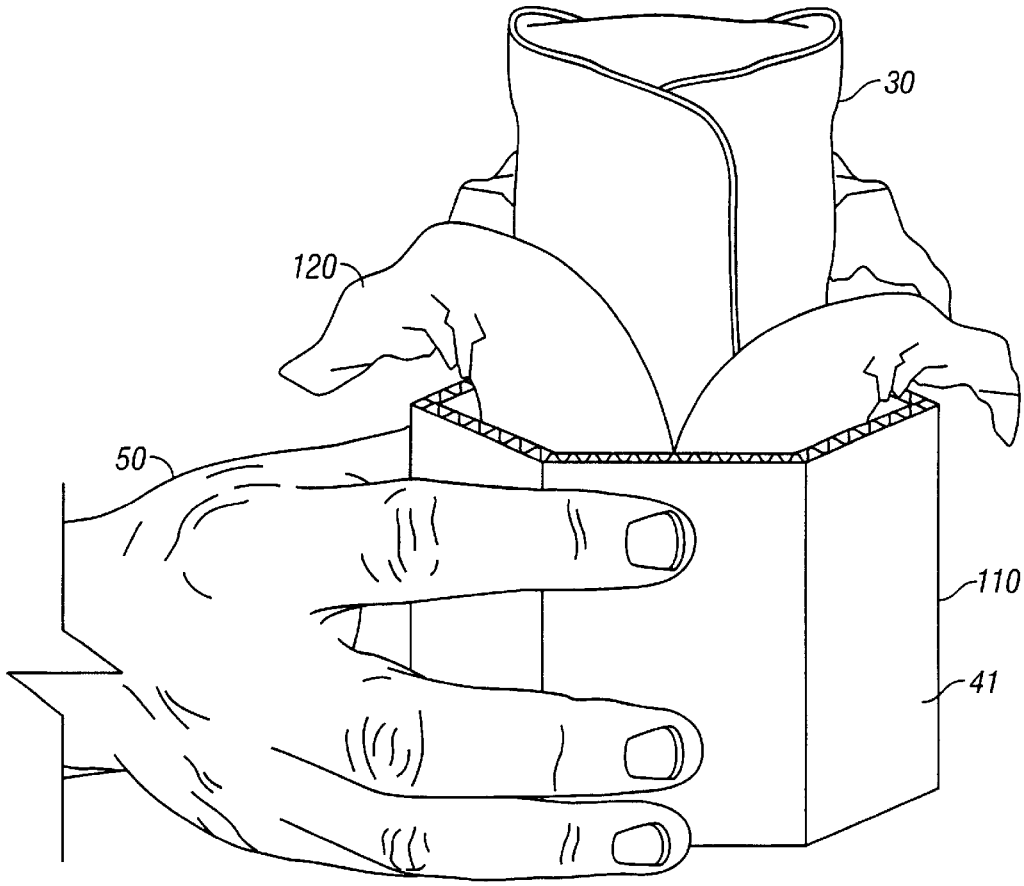

FIGS. 16A, 16B and 16C illustrate separation of the container 10 having two components 110, 120. FIG. 16A shows the separation of the outer component 110 of container 10 via a tear-strip 21 of which is positioned horizontally or vertically on the container. The tearing action results in a separation of the container into two parts 40, 41. Once the outer component 110 is separated into two parts, the inner component 120, in the form of pouch 120A or other rectangular configuration, can be peeled or pulled down, similar to a banana, to gain access to the food item 30. While peeling the inner component 120, the consumer can pull upward on the inner component 120 which provides easy access to the food item in the bottom of the inner component 120 (FIG. 16C). Alternatively, the container 10 can include a push-up mechanism in order to move the food item 30 up from the bottom of the container 10 as the food item 30 is being eaten.

The inner component 120 can be separated and/or opened for example, by using the top horizontal seal 121A that can vent under pressure and/or heat. Thus, after microwaving, the top seal 121A is weakened and is easy to open and/or split. Tear notches as known to one skilled in the art can be positioned along a horizontal line of weakness at the top 121 of the pouch 120A to enable the consumer to open the inner component 120. Other easy open mechanisms are also contemplated for the outer and inner components 110, 120. For example, an inner or outer component formed from rigid material can include an easy open mechanism such as a perforated, thread or strip embedded tear strip or tear tape. Inner or outer components formed from semi-rigid or flexible material can include easy open mechanisms such as a perforated, thread or strip embedded tear strip, a tear notch, oriented film, a laser etch line or a mechanical etch such as perforations, tear tape or tear glue or the inner component 120 can include a center split opening in order to allow access to the food product. In a specific embodiment, a spiral tear strip can be used in the outer component 110. The tearing action results in a downward spiral opening of the outer component. A spiral tear-strip would provide the consumer easy access to the bottom of the food item without the consumer having to handle the hot food item. The manufacturing of these easy open mechanisms are known to one skilled in the art of packaging.

Figure 17:
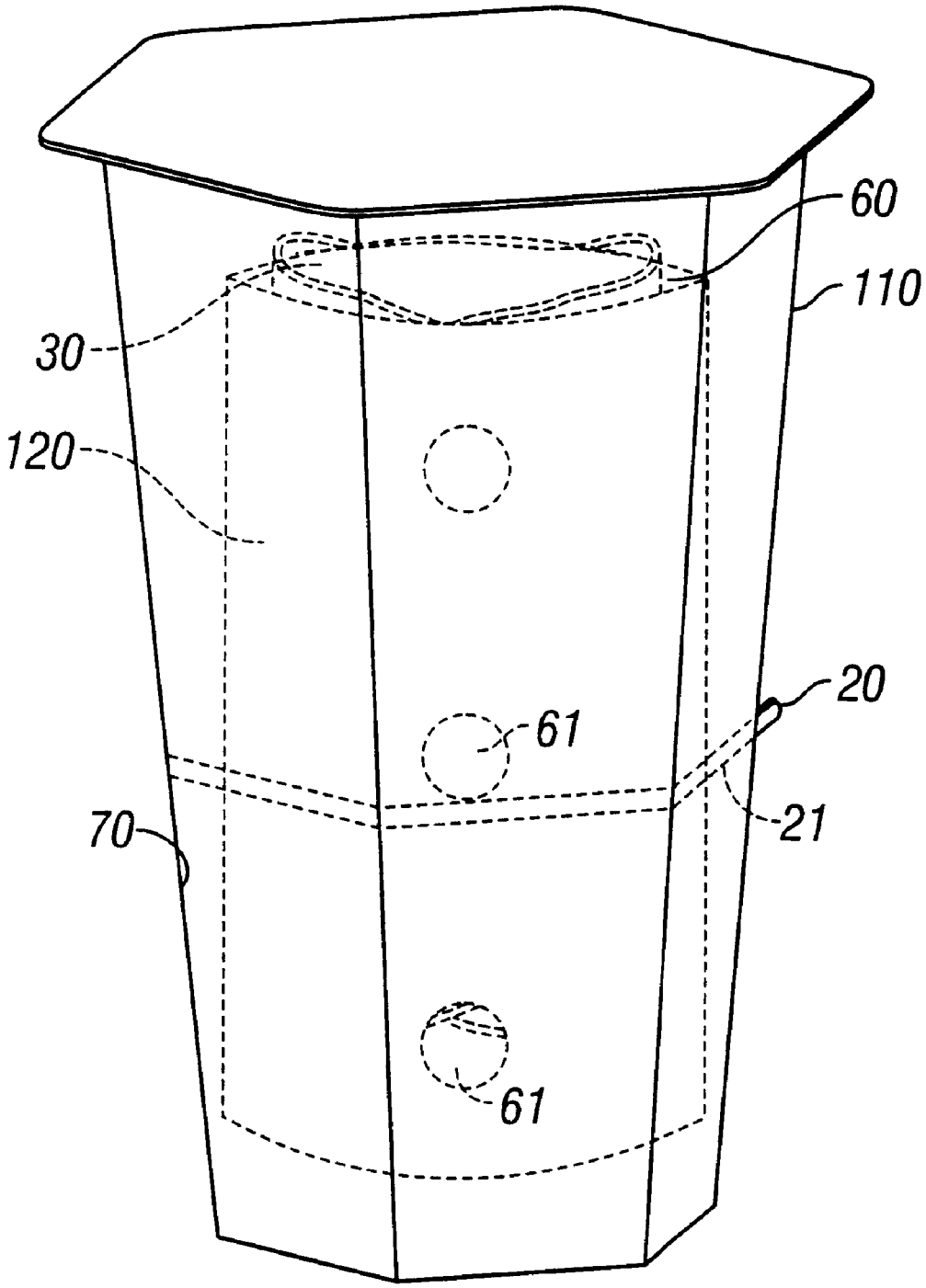
FIG. 17 illustrates a cross-sectional of the container having two components.

As described above, microwaveable containers can include a microwave susceptor surface 60 positioned as an inner surface of the container. In the specific embodiment of FIG. 17, the susceptor surface 60 is configured as an inner surface of the inner component 120. In this embodiment, the inner component 120 is a laminate comprising paper, susceptor, and heat sealable polyethylene terephthalate or cellophane, susceptor and heat sealable polyethylene terephthalate.

The subject invention comprises a number of embodiments. One embodiment includes an outer component 110 that is formed of a flexible, semi-flexible or rigid material that includes a thermal insulating layer 70 on either the outer or inner surface of the outer component 110 and a susceptor surface adjacent to the food item 30 (FIG. 4). Alternatively, the susceptor surface 60 can be omitted.

Figure 18A:
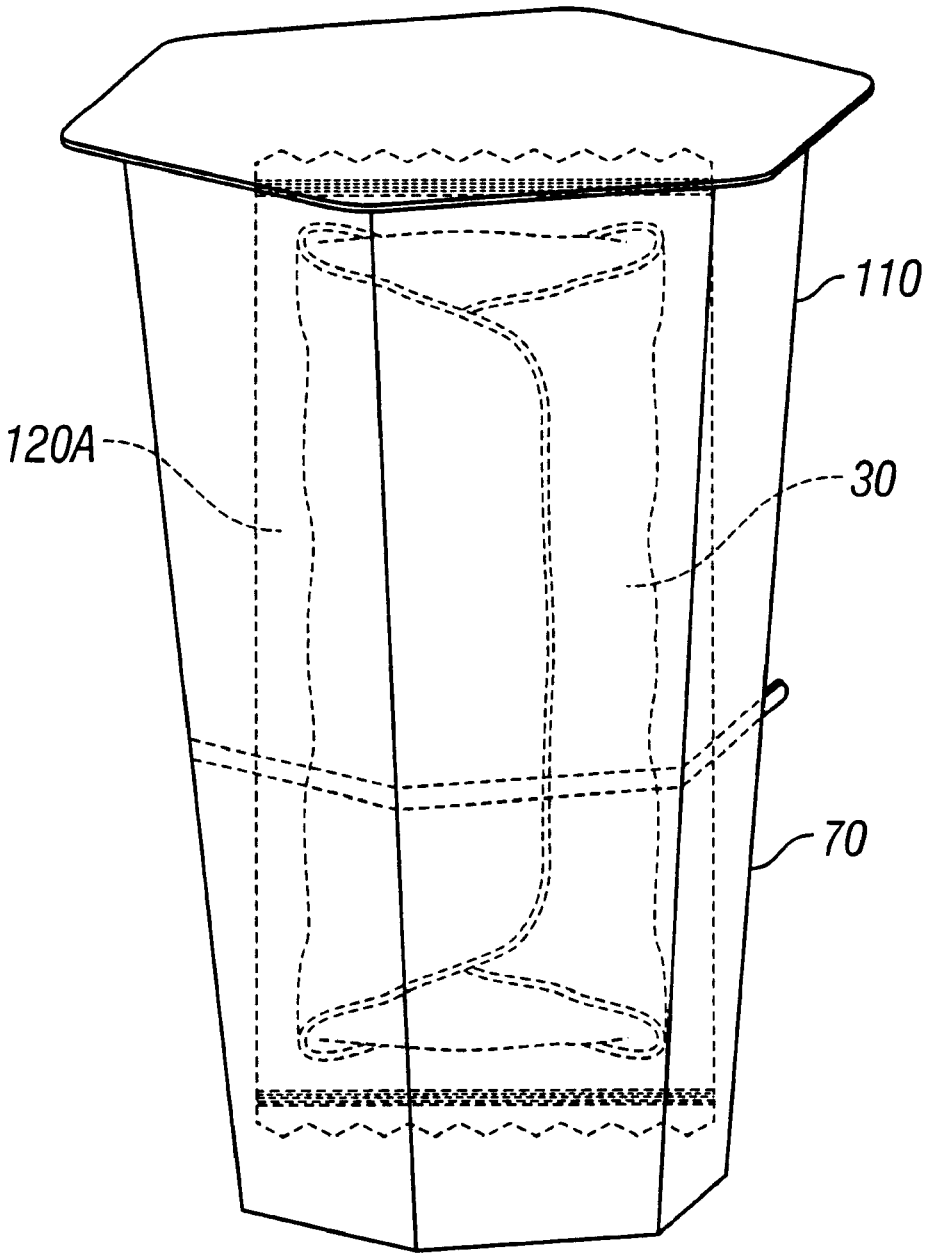
FIGS. 18A, 18B and 18C illustrate an alternate embodiment of the container having a flexible inner component and a semi-rigid outer component.
Figure 18B:
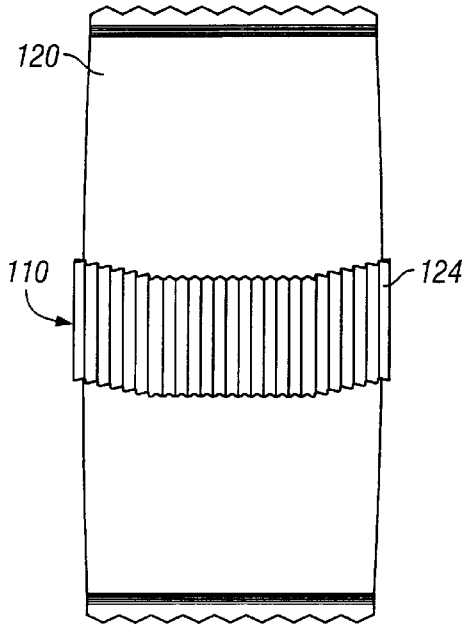
Figure 18C:
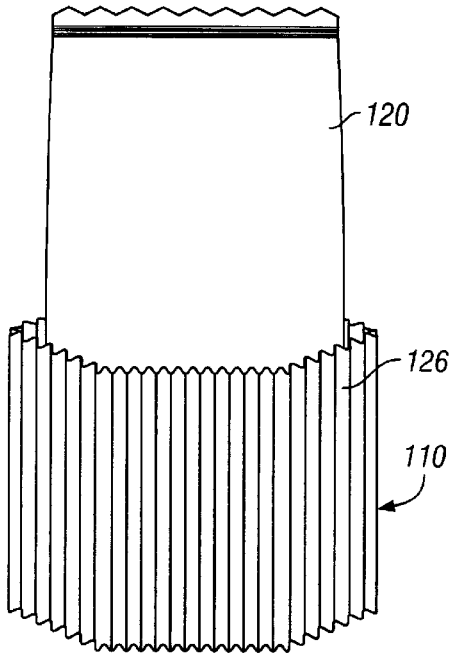

Another embodiment includes an inner component 120 formed from a flexible material, an outer component 110 formed from a semi-rigid material and thermal insulation 70 on at least a portion of the outer component 110. The outer component 110 can be in the shape of a sleeve 124 (FIG. 18A), a cup 126 (FIG. 18C) or carton 10A (FIG. 18A). Any of the outer components 110 can be formed entirely of a susceptor material 70. The inner component 120 can optionally include a susceptor surface.

In any of the embodiments, the sleeve 124 can generally be circular, cylindrical, rectangular or oval in shape or any other shape that can be placed around an outer or inner component 110, 120 or food item 30. Further, the sleeve 124 can be positioned parallel or perpendicular to the center axis of the outer or inner component 110, 120 or a food item 30. The cup 126 can cover a portion of the length or the entire length of a food item 30 or the outer or inner component 110, 120. Any of the outer components 110 can be formed entirely of a susceptor material 70. The inner component 120 can optionally include a susceptor surface 60.

Figure 19A:
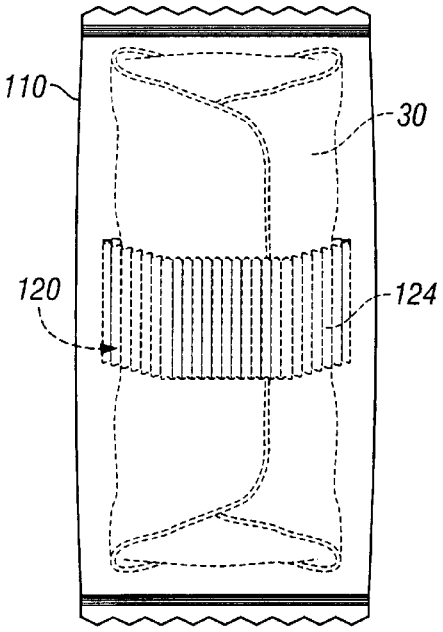
FIGS. 19A, 19B and 19C illustrate an alternate embodiment of the container having a semi-rigid inner component and a flexible outer component.
Figure 19B:
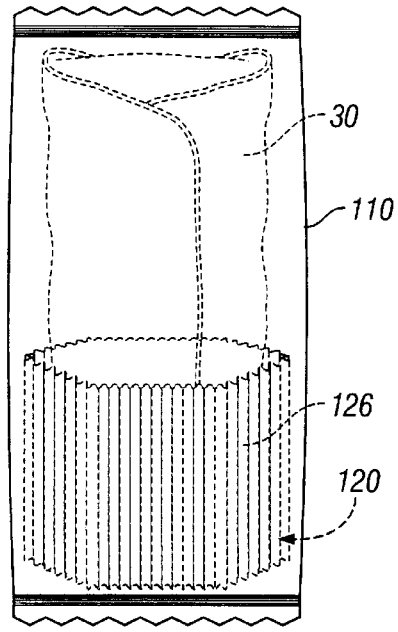
Figure 19C:
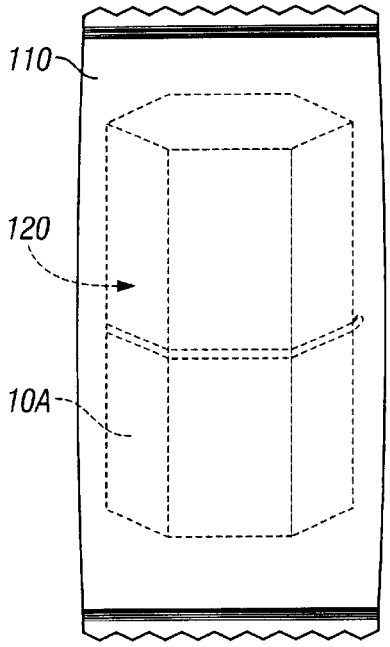

Alternatively, the outer component 110 can be formed of a flexible material and the inner component 120 can be formed from a semi-rigid material that optionally includes a susceptor surface. This embodiment of container 10 can include thermal insulation 70 on at least a portion of the inside or outside of the container. In this embodiment, the inner component 120 can be in the shape of a sleeve 124 (FIG. 19A), a cup 126 (FIG. 19B) or a carton 10A (FIG. 19C). Any of the inner components 120 can be formed entirely of a susceptor material 70.

Figure 20A:
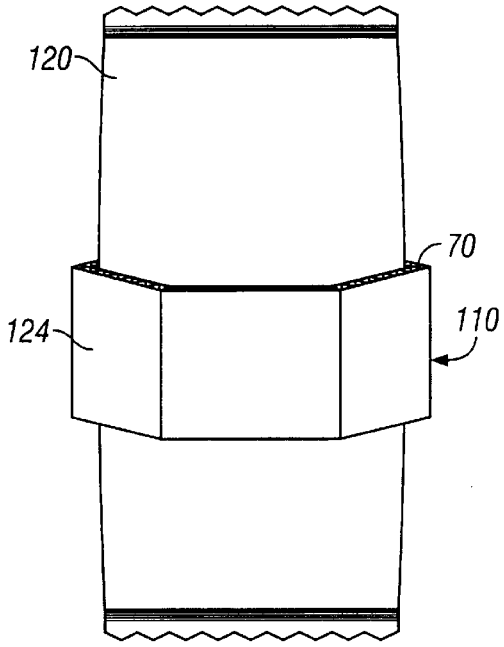
FIGS. 20A, 20B and 20C illustrate an alternate embodiment of the container having a flexible inner component and a flexible outer component.
Figure 20B:
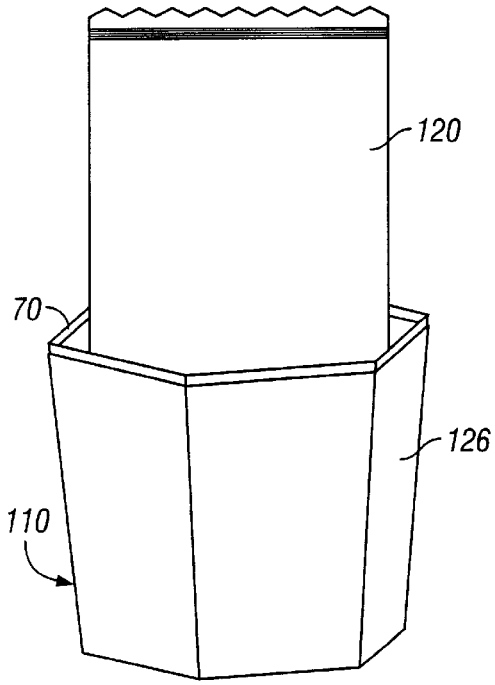
Figure 20C:
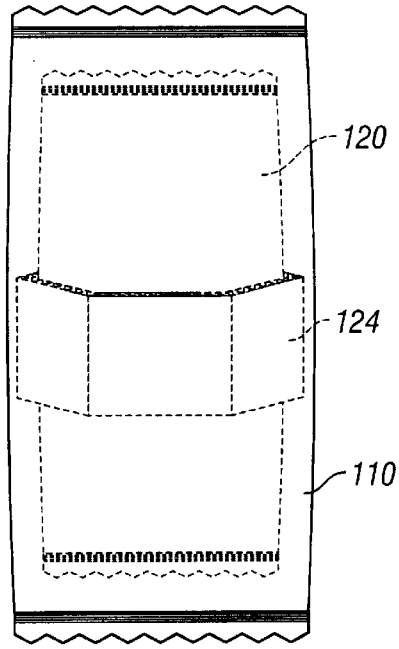

In yet another embodiment, both the outer and inner components 110, 120 can be formed from flexible material and optionally can include a susceptor surface 60. The inner component 120 can be in the shape of a sleeve 124 (FIG. 20A) or cup 126 (FIG. 20B) The sleeve 124 or cup 126 can be formed from a susceptor material 70. Alternatively, as illustrated in FIG. 20C, both the outer and inner components 110, 120 can be in the form of a pouch in which the inner component 120 includes a sleeve 124 formed from thermal insulating material 70.

Alternatively, an embodiment can be formed from only one component 10A (FIGS. 1A and 1B) in which the container 10 is formed from a microwave appropriate material, such as a thermal insulating material which would provide structure to the container 10. Venting of container 10 is optional. The container formed of thermal insulating material can also provide for even heating or cooking of the contents of the container while microwaving as well as providing an equilibrium of the contents' temperature after the container has been removed from a microwave oven.

The hand held container of the present invention also includes features such as a moisture barrier to prevent the container 10 from becoming soggy and leak-proof seals and/or leak-proof ends to prevent the food item 30 from leaking out of either the inner or outer components 110, 120.

In another embodiment of the present invention, the container may further include graphics on the outside or inside of the container. It is envisioned that the graphics are printed on the outside or inside of the container using thermotropic ink or resin to display or provide instructions for handling the food item. Thermotropic inks change color at elevated temperatures or temperature changes. Any thermotropic ink and method for applying thermotropic ink can be used in the present invention, provided that the ink used is capable of being stored and handled at temperatures typical for frozen and/or chilled foods. See U.S. Pat. Nos. 4,155,895, which is incorporated herein by reference. The present invention can also include thermotropic ink as a temperature indicator or any other temperature indicating device that can be used to alert a consumer that a food item has been cooked or is too hot to eat.

It is also envisioned that the present invention can be utilized for any purpose in which hand held packaging suitable for microwaving is desired. For example the microwaveable container can be used for craft materials in which a craft material needs to be heated, such as wax. In the field of cosmetics, the hand held package could be utilized to contain facial or body wrap products that requiring heating. In the medical field, the hand held package could be utilized for medication, wraps or casting materials that require heating.

Although the present invention and its advantages have been described in detail, it should be understood that various changes, substitutions, and alterations can be made herein without departing from the spirit and scope of the invention as defined by the appended claims. As one of ordinary skill in the art will readily appreciate from the disclosure of the present invention, processes, manufacture, compositions of matter, means, methods, or steps presently existing or later to be developed that perform substantially the same function or achieve substantially the same result as the corresponding embodiments described herein may be utilized according to the present invention. Accordingly, the appended claims are intended to include within the scope of such processes, manufacture, compositions of matter, means, methods, or steps.

What is claimed is:

1. A hand held microwaveable container comprising a microwave susceptor surface and a thermal insulating layer that is separate from the susceptor suface, the insulating layer allowing a microwaved container to be removed from a microwave oven and held in a user's hand, wherein the thermal insulating layer provides a lowered rate of heat transfer from contents inside of the container to an outer surface of the container.

2. The container of claim 1, wherein the susceptor surface comprises a substrate having a microwave-absorptive coating region, the microwave-absorptive region being deposited, printed, extruded, or laminated on said substrate.

3. The container of claim 1, further including an opening mechanism for easily opening the container.

4. The container of claim 3, wherein the opening mechanism is selected from a group consisting of tear notches, tear strip, tear tape, oriented film, laser etch line, perforations, and tear glue.

5. The container of claim 1, further including a venting mechanism.

6. The container of claim 1, wherein the thermal insulating material is selected from a group consisting of thermoplastic synthetic resin, fluted board, embossed paper, polystyrene foam, polypropylene foam, polyethylene terephthalate foam, and poly-ester in any form.

7. The container of claim 1, wherein the contents within the container is a food item.

8. A hand held microwaveable container comprising:

a container for microwave cooking or heating wherein the container comprises an outer component formed from a semi-rigid material and an inner component formed from a flexible material having a microwave susceptor surface; and a thermal insulating surface on at least a portion of the outer components wherein the thermal insulating surface is separate from the susceptor surface.

9. The container of claim 1, wherein the susceptor surface comprises a substrate having a microwave-absorptive coating region, the microwave-absorptive region being deposited, printed, extruded, or laminated on said substrate.

10. The container of claim 8, further including an opening mechanism for easily opening the container.

11. The container of claim 9, wherein the opening mechanism is selected from a group consisting of tear notches, tear strip, tear tape, oriented film, laser etch line, perforations, and tear glue.

12. The container of claim 8, further including a venting mechanism.

13. The container of claim 8, wherein the outer component is in the shape of a sleeve, a cup or a carton.

14. The container of claim 8, wherein the thermal insulating material is selected from a group consisting of thermoplastic synthetic resin, fluted board, embossed paper, polystyrene foam, polypropylene foam, polyethylene terephthalate foam, and poly-ester in any form.

15. The container of claim 8, wherein the semi-rigid material of the outer component is selected from a group consisting of paperboard, laminated paperboard, corrugated board, paperboard canister material, and plastic sheeting.

16. The container of claim 15, wherein the corrugated board is selected from the group consisting of corrugated board in the form of micro-flutes, E-shaped flutes, F-shaped flutes, B-shaped flutes, and C-shaped flutes.

17. The container of claim 15, wherein the plastic sheeting includes polyethylene terephthalate.

18. The container of claim 15, wherein the paperboard is laminated with film selected from a group consisting of susceptor film, polyethylene terephthalate, and polypropylene.

19. The container of claim 8, wherein the flexible material of the inner component is selected from a group consisting of film or sheets of polyethylene terephthalate, film or sheets of polypropylene, foamed polypropylene, foamed polyethylene terephthalate, paper/polyethylene terephthalate/susceptor laminate, cellophane/polyethylene terephthalate/susceptor laminate, polyethylene terephthalate/susceptor film, aluminium laminate, and paperboard susceptor laminate.

20. A hand held microwaveable container comprising:

a container for microwave use, wherein the container comprises a component formed from a rigid, semi-rigid or flexible material having a microwave susceptor surface; and a thermal insulating surface on at least a portion of the component, wherein the thermal insulating surface is separate from the microwave susceptor.

21. The container of claim 20 wherein the component further includes inner and outer components.

22. The container of claim 20, wherein the component is laminated.

23. The container of claim 22, wherein the susceptor surface comprises a substrate having a microwave-absorptive coating region, the microwave-absorptive region being deposited, printed, extruded, or laminated on said substrate.

24. The container of claim 20, further including an opening mechanism for easily opening the container.

25. The container of claim 24, wherein the opening mechanism is selected from a group consisting of tear notches, tear strip, tear tape, oriented film, laser etch line, perforations, and tear glue.

26. The container of claim 20, further including a venting mechanism.

27. The container of claim 20, wherein the thermal insulating material is selected from a group consisting of thermoplastic synthetic resin, fluted board, embossed paper, polystyrene foam, polypropylene foam, polyethylene terephthalate foam, and poly-ester in any form.

28. The container of claim 20, wherein the flexible material of the component is selected from a group consisting of film or sheets of polyethylene terephthalate, film or sheets of polypropylene, foamed polypropylene, foamed polyethylene terephthalate, paper/polyethylene terephthalate/susceptor laminate, cellophane/polyethylene terephthalate/susceptor laminate, polyethylene terephthalate/susceptor film, aluminium laminate, and paperboard susceptor laminate.

29. The container of claim 20, wherein the semi-rigid material of the component is selected from a group consisting of paperboard, laminated paperboard, corrugated board, paperboard canister material, and plastic sheeting.

30. The container of claim 29, wherein the corrugated board is selected from the group consisting of corrugated board in the form of micro-flutes, E-shaped flutes, F-shaped flutes, B-shaped flutes, and C-shaped flutes.

31. The container of claim 29, wherein the plastic sheeting includes polyethylene terephthalate.

32. The container of claim 29, wherein the paperboard is laminated with film selected from a group consisting of susceptor film, polyethylene terephthalate, and polypropylene.

33. The container of claim 20, wherein the rigid material of the component is selected from a group consisting of injection molded plastics, thermoformed plastics, thermoformed terephthalate, injection molded polyethylene terephthalate, paperboard, laminated paperboard, laminated molded pulp, single side fluted board, double side fluted board, corrugated board, and embossed paperboard.

34. The container of claim 20, wherein the microwave use of the container includes cooking or heating a food item contained within the container.

35. The container of claim 20, wherein the microwave use of the container includes heating an item contained within the container.

* * * * *